US007674991B2

(12) United States Patent
Baird et al.

(10) Patent No.: US 7,674,991 B2
(45) Date of Patent: Mar. 9, 2010

(54) PEDAL ASSEMBLIES AND METHODS FOR SIGNAL CONTROL

(76) Inventors: Derrick L. Baird, 1017 Josepi Dr., Knoxville, TN (US) 37918; John C. McCracken, 5510 Ridgefield Dr., Knoxville, TN (US) 37912

( * ) Notice: Subject to any disclaimer, the term of this patent is extended or adjusted under 35 U.S.C. 154(b) by 929 days.

(21) Appl. No.: 11/334,115

(22) Filed: Jan. 18, 2006

(65) Prior Publication Data

US 2006/0156903 A1 Jul. 20, 2006

Related U.S. Application Data

(60) Provisional application No. 60/644,802, filed on Jan. 18, 2005.

(51) Int. Cl.
*H01H 3/14* (2006.01)

(52) U.S. Cl. ..... 200/61.29; 200/86.5

(58) Field of Classification Search ..... 200/61.29
See application file for complete search history.

(56) References Cited

U.S. PATENT DOCUMENTS

| | | | | |
|---|---|---|---|---|
| 2,460,494 | A | 2/1949 | Eisenberg et al. | |
| 2,986,953 | A | 6/1961 | De Armond et al. | |
| 4,965,417 | A * | 10/1990 | Massie | 200/86.5 |
| 5,121,889 | A * | 6/1992 | Carey, Jr. | 244/234 |
| 5,535,642 | A * | 7/1996 | Moll | 74/561 |
| 5,635,777 | A * | 6/1997 | Telymonde et al. | 307/119 |

OTHER PUBLICATIONS

Morely mode SLST instruction manual, date unknown, believed to exist prior to the filing date of the present application.

Extending Music Performance & Composition Using Two Novel Interaction Techniques by Farhan Mohamed, Sidney Fels, Florian Vogt, The University of British Columbia Department of Electrical & Computer Engineering Human Communications Technology Laboratory, date unknown, believed to exist prior to the filing date of the present application.

'60s Fender Fuzz Wah Guitar Effect Pedal Vintage Rare!!, posted Feb. 9, 2005, believed to exist prior to the filing date of the present application.

(Continued)

*Primary Examiner*—Michael A Friedhofer
*Assistant Examiner*—Lheiren Mae A Anglo
(74) *Attorney, Agent, or Firm*—Withers & Keys, LLC

(57) ABSTRACT

Pedal assemblies and methods provide for signal control, such as for controlling audio and/or effects path signals used in generating audio from a musical instrument. The pedal assemblies may provide for simultaneous audio and effects control via electrical pathways dedicated to each. Rotation of the pedal about one or more axes of rotation results in modifying an electrical characteristic of devices of the pedal that control the audio and effects path signals. A particular axis of rotation that modifies the electrical characteristic of a device may be configured to produce a particular audio or effects path control based on which of the jacks are in use such that by changing the jacks that are in use, the function of a particular axis of rotation may change. Furthermore, a pedal assembly may provide for two axes of rotation where the centers of rotation of the two axes are non-coincident. The two axes of rotation may be better isolated as a result.

14 Claims, 21 Drawing Sheets

OTHER PUBLICATIONS

Stunning DeArmond Volume/Tone Pedal -Model 610- SEP1965, posted Feb. 11, 2005, believed to exist prior to the filing date of the present application.
Vintage 60's Fender Fuzz Wah Volume OD Pedal Tonebender, posted Jan. 24, 2005, believed to exist prior to the filing date of the present application.
1955 Bigsby Volume & Tone Pedal Steel Guitar lap NoRes!, posted Jan. 27, 2005, believed to exist prior to the filing date of the present application.
Vintage 70s DeArmond Volume & Tone Pedal Model 610, posted Jan. 21, 2005, believed to exist prior to the filing date of the present application.
Vintage DeArmond Volume/Tone Pedal, posted Jan. 23, 2005, believed to exist prior to the filing date of the present application.
Bigsby pedal photograph, believed to exist prior to the filing date of the present application.
Morley pedal, 11 photographs, believed to exist prior to the filing date of the present application.

* cited by examiner

| ITEM NO. | QTY. | PART NUMBER | DESCRIPTION |
|---|---|---|---|
| 1 | 1 | | Expression Pedal Base |
| 2 | 1 | | Pivot Fixture |
| 3 | 1 | | Pedal |
| 4 | 1 | | Pedal Pivot Mount |
| 5 | 1 | McMASTER 95495K22 | 1/2"OD x 1/4"H Rubber Bumper |
| 6 | 1 | | Cover |
| 7 | 2 | McMaster 6384K52 | Shielded Radial Ball Bearing, 11/16"OD x 1/4"ID x 1/4"L |
| 8 | 2 | McMaster 91259A533 | 1/4"OD x 1/4"L x #10-24 Shoulder Screw |
| 9 | 1 | McMaster 5909K36 | Torrington Needle Thrust Bearing Cage Assembly |
| 10 | 2 | McMaster 5909K49 | Torrington Needle Thrust Bearing Washer |
| 11 | 1 | | Pivot Bearing Pilot Spacer |
| 12 | 2 | McMaster 6389K352 | 1/4" Bore x 3/8"OD x 1/4"L Plain Bearing |
| 13 | 2 | McMaster 90295A150 | 1/4" Nylon Flat Washer |
| 14 | 1 | | 1/4" SAE Flat Washer |
| 15 | 2 | McMaster #92949A541 | 1/4-20 x 7/8" BHCS |
| 16 | 1 | Alpha 31VA501 | 100k-ohm Rotary Potentiometer, 300-deg. |
| 17 | 1 | SDP #A-1M-2-TA32060 | Modified 60-tooth, 32-pitch Acetal Spur Gear |
| 18 | 1 | SDP #A-1M-2-TA32010 | 10-tooth, 32-pitch Acetal Spur Gear |
| 19 | 1 | SDP #A-1M-2-TA32016 | 16-tooth, 32-pitch Acetal Spur Gear |
| 20 | 1 | SDP #A-1M-2-TA32040 | 40-tooth, 32-pitch Acetal Spur Gear |
| 21 | 2 | | 1/4-20 PEM Nut, Self-Locking |
| 22 | 1 | | Rotary Potentiometer Mounting Bracket |
| 23 | 1 | | Slide Potentiometer Mounting Bracket |
| 24 | 3 | Alpha 312-9201-100k | Alpha 100k-ohm Slide Potentiometer, 45mm Travel |
| 25 | 1 | | Pivot Fixture Front Plate |
| 26 | 2 | McMASTER 9723K88 | 1/2"OD x 1/8"H Rubber Bumper |
| 27 | 2 | McMASTER 6294K86 | 3/16" Bore x 5/16"OD x 1/4"L Flange Bearing |
| 28 | 1 | | Pedal Gear Train Mounting Shaft |
| 29 | 1 | McMaster 90298A575 | 5/16" dia. x 5/16"L x 1/4-20 Shoulder Screw |
| 30 | 4 | McMaster 90135A433 | 5/16" x 0.005" Shoulder Screw Lengthening Shim |
| 31 | 2 | McMaster #92949A106 | #4-40 x 1/4" BHCS |
| 32 | 8 | McMaster #92949A144 | BHCS #6-32 x 1/4" |
| 33 | 8 | McMaster #92949A146 | #6 x 3/8" Sheet Metal Self-Tapping Screw |
| 34 | 1 | | Forward Travel Stop Pad |

Fig. 19

| ITEM NO. | QTY. | DESCRIPTION | Material |
|---|---|---|---|
| 201 | 1 | Expression Pedal Base | 0.13" 3003 Aluminum |
| 202 | 1 | Pivot Fixture | 3/16" Aluminum |
| 203 | 1 | Cover | 0.04" Aluminum |
| 204 | 2 | Dual Isolated Make-Break Switch Jack | |
| 205 | 3 | Jack | |
| 206 | 2 | PEM Nut CLS #6-32 | Stainless Steel |
| 207 | 1 | Pedal Pivot Mount | 3/16" Aluminum |
| 208 | 3 | 1/4" Bore x 5/16"OD x 3/16"L Plain Bearing | SAE 841 or SAE 660 Bronze |
| 209 | 1 | Pedal | 3/16" Aluminum |
| 210 | 2 | 1/4-20 x 5/8" PEM Stud | Stainless Steel |
| 211 | 1 | 1/2"OD x 1/4"H Rubber Bumper | Vinyl, Adhesive Back |
| 212 | 1 | Pivot Fixture Front | 3/16" Aluminum |
| 213 | 2 | 1/4" Nylon Flat Washer | Nylon 6/6 |
| 214 | 2 | 1/4" SAE Flat Washer | Stainless Steel |
| 215 | 3 | BHCS 1/4-20 x 3/4" | 18-8 Stainless Steel |
| 99''' | 2 | 100k-ohm Rotary Potentiometer, 300-deg. | |
| 217 | 1 | 10-tooth, 32-pitch Acetal Spur Gear | Acetal |
| 218 | 1 | 16-tooth, 32-pitch Acetal Spur Gear | Acetal |
| 219 | 1 | 40-tooth, 32-pitch Acetal Spur Gear | Acetal |
| 220 | 3 | 1/4-20 PEM Nut, Self-Locking | Stainless Steel |
| 221 | 1 | Rotary Potentiometer Mounting Bracket | 0.06" Aluminum |
| 222 | 2 | 1/2"OD x 1/8"H Rubber Bumper | Vinyl, Adhesive Back |
| 223 | 2 | 3/16" Bore x 5/16"OD x 1/4"L Flange Bearing | MDS Filled Nylon |
| 224 | 1 | Pedal Gear Train Mounting Shaft | Steel or Stainless Steel |
| 225 | 2 | #4-40 x 1/4" BHCS | 18-8 Stainless Steel |
| 226 | 4 | BHCS #6-32 x 1/4" | 18-8 Stainless Steel |
| 227 | 4 | #6 x 3/8" Sheet Metal Self-Tapping Screw | 18-8 Stainless Steel |
| 99', 99'' | 1 | Dual Ganged 100K-Ohm Rotary Potentiomer, 300-deg. | |
| 229 | 2 | 20-tooth, 32-pitch Acetal Spur Gear | Acetal |
| 230 | 1 | Forward Rotary Pot Mount | 0.06" Aluminum |
| 231 | 1 | Lower Wear Pad | 1/8" UHMW |
| 232 | 1 | 5/16"ID x 1-1/2" Wear Washer | 1/8" UHMW |
| 233 | 1 | Pedal Forward Travel Stop Pad | Push-on Rubber Edge Trim |
| 234 | 1 | 5/16"ID x 1"OD Wear Washer | 1/8" UHMW |
| 235 | 2 | FHSCS #6-32 x 3/8" | Alloy Steel Black Oxide |
| 236 | 1 | Non-Slip Cover | 4"W 3M No Slip Tape |

Fig. 20

PEDAL ASSEMBLIES AND METHODS FOR SIGNAL CONTROL

RELATED APPLICATIONS

The present application claims priority to U.S. Provisional Application 60/644,802 filed on Jan. 18, 2005, and entitled Multi-Axis Expression Pedal.

TECHNICAL FIELD

The present invention is related to pedals. More particularly, the present invention is related to pedal assemblies for providing signal control through rotation of a pedal about one or more axes.

BACKGROUND

Pedal assemblies provide an operator of equipment with a measure of control through movements of a foot of the operator. In the case of musical instruments as well as other equipment, a musician typically involves both hands in the playing of the instrument so that the musician's feet must be used to provide additional controls. A pedal assembly may be used by a musician to control an audio path, such as to vary the volume of an amplified instrument, or an effects path such as to modify the audio with an effect, by motion of the musician's foot.

An operator of equipment, and particularly a musician, may prefer a maximum degree of control for several parameters via use of pedals. However, the musician is limited in that there are at most two feet available to manipulate pedals, and if the musician is standing while performing, then using two feet for two pedals contemporaneously is difficult if not impossible. Therefore, providing a musician with control over various parameters of the audio being produced by the instrument through the use of multiple pedals is not optimal.

SUMMARY

Embodiments of the present invention address these issues and others by providing pedal assemblies and methods for signal control. One example of a pedal assembly may provide two axes of rotation where the centers of rotation of the axes are non-coincident so that the operator of the pedal may use each axis independently to control multiple parameters of operation of a musical instrument or other equipment. Furthermore, an example of a pedal assembly may provide for control of parameters via particular axes of rotation of the pedal based on how signal jacks of the pedal assembly are connected where altering how the signal jacks are connected alters which axes control which parameters. Additionally, in the context of a pedal assembly used in conjunction with a musical instrument, the pedal assembly may provide for an electrical pathway for control of an audio path signal while also providing for an electrical pathway for control of an effects path signal.

One embodiment is a pedal assembly for signal control that includes a pedal base and a pedal plate pivotally supported in relation to the pedal base. The pedal plate has a first center of rotation relative to the pedal base about a first axis and has a second center of rotation relative to the pedal base about a second axis. The first center of rotation is non-coincident with the second center of rotation.

Another embodiment is a pedal assembly for signal control that includes a pedal plate pivotably supported in relation to a pedal base such that the pedal plate has at least one axis of rotation relative to the pedal base. The pedal assembly includes a set of electrical connectors including an input electrical connector and first and second output electrical connectors, at least one of the output electrical connectors having a switching function. The pedal assembly further includes three devices mechanically coupled to the pedal plate, the three devices having an electrical characteristic altered by the rotation of the pedal plate relative to the pedal base. A first of the three devices is in an electrical pathway from the input electrical connector to the first output electrical connector while the second and third devices are out of the electrical pathway from the input electrical connector to the first output electrical connector when an electrical plug is present in the first electrical output connector but an electrical plug is not present in the second electrical output connector. The first of the three devices is in an electrical pathway from the input electrical connector to the first output electrical connector and in an electrical pathway from the input electrical connector to the second output electrical connector and the second of the three devices is in the electrical pathway from the input electrical connector to the first output electrical connector but not the electrical pathway from the input electrical connector to the second output electrical connector and the third of the three devices is in an electrical pathway from the input electrical connector to the second output electrical connector but not the electrical pathway from the input electrical connector to the first output electrical connector when an electrical plug is present in the first electrical output connector while another electrical plug is present in the second electrical output connector.

Another embodiment is a pedal assembly for signal control that includes a pedal assembly for signal control. The pedal assembly includes a pedal plate pivotably supported in relation to a pedal base such that the pedal plate has two axes of rotation relative to the pedal base. The pedal assembly further includes a set of electrical connections corresponding to: a source input connection, a first source output connection that when connected provides for either a first axis volume controlled source output or a second axis first stereo channel source output volume, a second source output connection that when connected provides for either a second axis volume controlled source output or a second axis second stereo channel output volume, at least one of the electrical inputs having a switching function, a first effects loop connection that when connected provides for a first axis effects control, and a second effects loop connection that when connected provides for a second axis effects control. The pedal further includes four devices mechanically coupled to the pedal plate, the four devices having an electrical characteristic altered by the rotation of the pedal plate relative to the pedal base. A first of the four devices corresponds to the first axis volume controlled source output if the first effects loop connection is unplugged and otherwise corresponds to the first effects loop control. A second of the four devices corresponds to the second axis volume controlled source output if the first source output connection is unplugged and otherwise corresponds to the second axis second stereo channel output volume. A third of the four devices corresponds to the second axis first stereo channel output volume, and a fourth of the four devices corresponding to the second effects loop control.

Another embodiment is a method of using a pedal to control sound generation, where the pedal includes a pedal plate pivotably supported in relation to a pedal base such that the pedal plate has at least one axis of rotation relative to the pedal base. The pedal includes a set of at least three electrical connections including an input electrical connection and two control connections, and the pedal further includes at least two devices mechanically coupled to the pedal plate, the at least two devices having an electrical characteristic altered by the rotation of the pedal plate relative to the pedal base. The method involves plugging a signal source of the sound into the input electrical connection of the pedal to thereby create a circuit path from the signal input lead through a first of the at least two devices to a first control connection of the pedal. The method further involves plugging a signal lead of a sound altering device into the first control connection of the pedal and plugging an effects control lead into a second control connection of the pedal to thereby create a circuit path through the second of the at least two devices. Additionally, the method involves manipulating the pedal plate to alter an audio signal being received through the input electrical connection and output from the first control connection and manipulating the pedal plate to alter an effects signal being looped through the second control connection.

DESCRIPTION OF THE DRAWINGS

FIG. 19 shows a bill of materials for the embodiment of FIGS. 2 and 3.

FIG. 20 shows a bill of materials for the embodiment of FIGS. 15, 16A, and 16B.

DETAILED DESCRIPTION

Embodiments of the present invention provide for pedal assemblies that allow for signal control. Certain embodiments provide for multiple axes of rotation of a pedal plate of the pedal assembly thereby allowing individual control of at least two parameters of signal control. Certain embodiments provide for configuration of the pedal assembly for controlling various parameters through rotation of the pedal plate by having electrical plugs inserted into particular jacks of the pedal assembly. Furthermore, in the context of audio signal control, certain embodiments provide for the control of an audio path signal as well as an effects path signal through the same pedal and at the same time.

Figure 1:
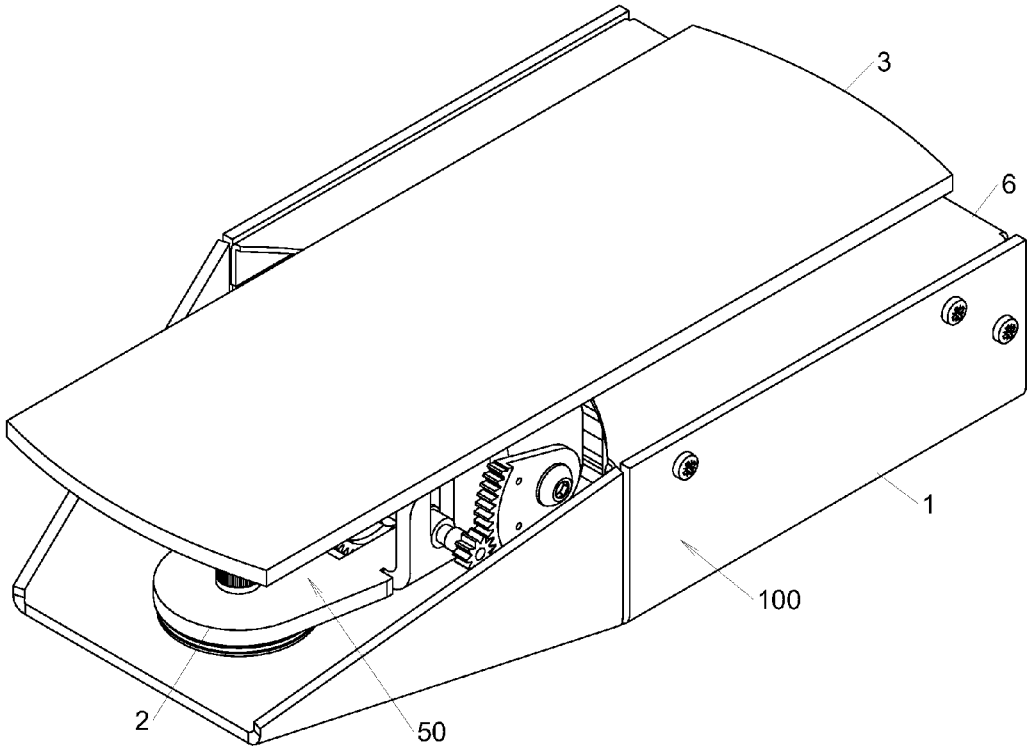
FIG. 1 is a perspective rear left-side view of one embodiment of an assembled multi-axis foot pedal showing the back, side and top of the foot pedal.

FIG. 1 is a perspective rear left-side view of a fully assembled multi-axis pedal assembly 100 according to one illustrative embodiment. The pedal assembly 100 includes a pedal plate 3 that is pivotably attached to a pedal base 1. As shown, a rotational assembly 50 acts as a support for the pedal plate 3 and provides the pivotal attachment of the pedal plate 3 to the pedal base 1 such that the pedal plate 3 can rotation about two different axes relative to the pedal base 1. In this example, the rotational assembly 50 includes a support plate 2 as well as various other components discussed below in relation to FIGS. 2 and 3. The rotation about the two different axes, where the centers of rotation of the two axes are non-coincident, is discussed below and specifically shown in FIGS. 4A and 4B.

Figure 2:
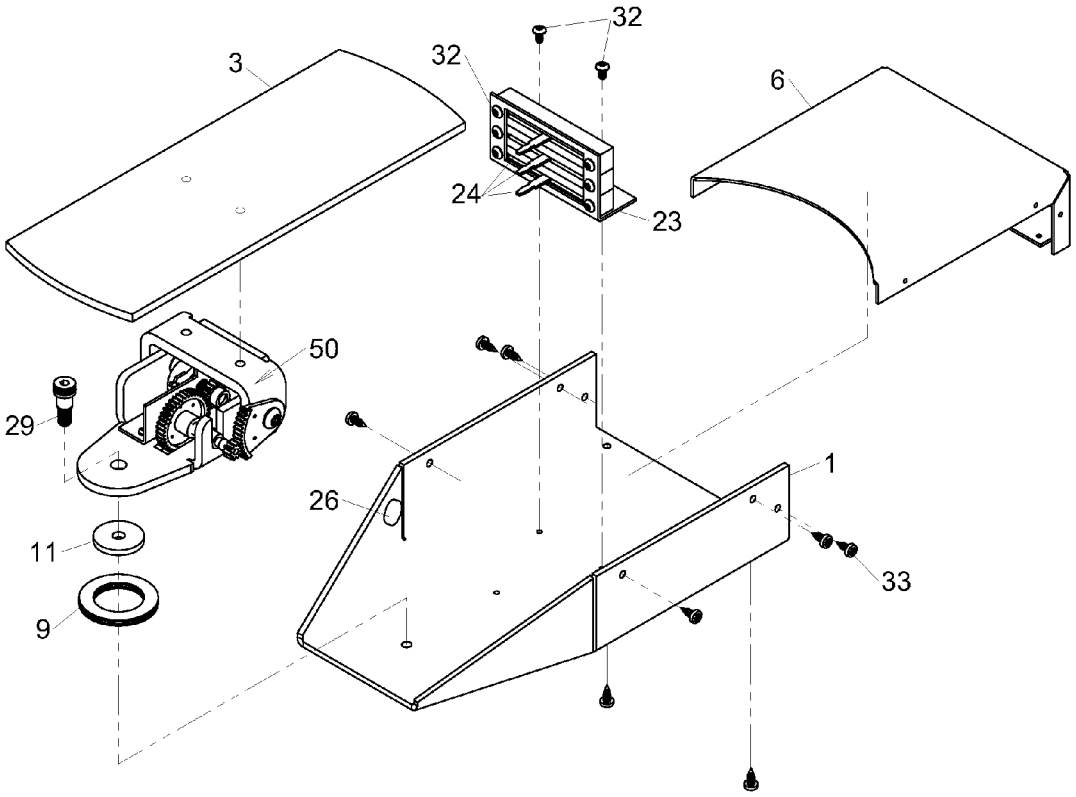
FIG. 2 is a perspective rear left-side view of an exploded assembly of the embodiment of FIG. 1.
Figure 15:
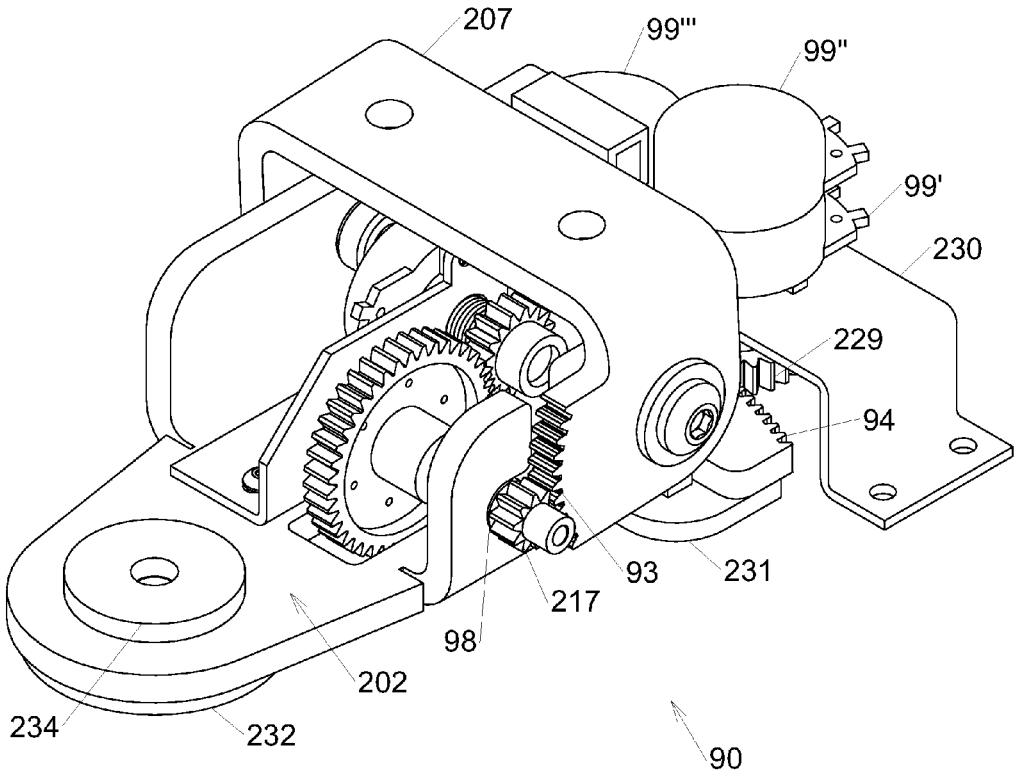
FIG. 15 is a perspective rear left-side view of an exploded pedal plate support assembly of a pedal of an alternative embodiment.

FIG. 2 is a perspective rear left-side view of the multi-axis pedal assembly embodiment as an exploded assembly. An expression pedal base, pedal base, or base 1 is shown with a plurality of holes for mounting the parts to the base 1. A rotational assembly 50 is attached to the pedal base 1 by means of a shoulder screw 29. The longitudinal axis is the center of rotation of the pedal plate 3 in one axis relative to the pedal base 1. A thrust bearing assembly or thrust bearing 9 with a bearing washer on both sides of the thrust bearing 9 is between the rotational assembly 50 and the base 1. The thrust bearing 9 is centered on an axis of rotation of the shoulder screw 29. A pilot spacer 11 is concentric and interior to the trust bearing assembly 9. A shim is assembled around the shoulder screw 29 to bear against the rotational assembly 50. As discussed below in relation to an alternative embodiment as shown in FIGS. 15 and 16, the bearings may be replaced by various polymer based bushings.

A pedal plate 3 is bolted, welded, or otherwise attached to the rotational assembly 50 through holes in the pedal plate 3. A rubber stop 26 is adhered to an interior surface of the pedal base 1 and aligned with the most prominent edge of the rotational assembly 50 at extreme left and right positions. A device with a mechanically modifiable electrical characteristic such as a slider potentiometer or slider pot 24 is used at three places on a slider potentiometer bracket or slider pot bracket 23 and attached with bracket screw 32. The number of places to include a device such as a potentiometer, and thus the number of devices, is a matter of design choice dependent upon the number of functions to be performed by the rotation of the pedal plate 3 about each axis. Additionally, the device may be of other types besides a resistive potentiometer, such as a variable inductor or variable capacitor. Returning to this example, the slider pot bracket is screwed to the bottom of base 1 with bracket screw 32. A cover 6 is assembled to the interior of base 1 with sheet metal screw 33. Input and output jacks (shown in FIGS. 5-14) are mounted through the front of the cover 6.

Figure 3:
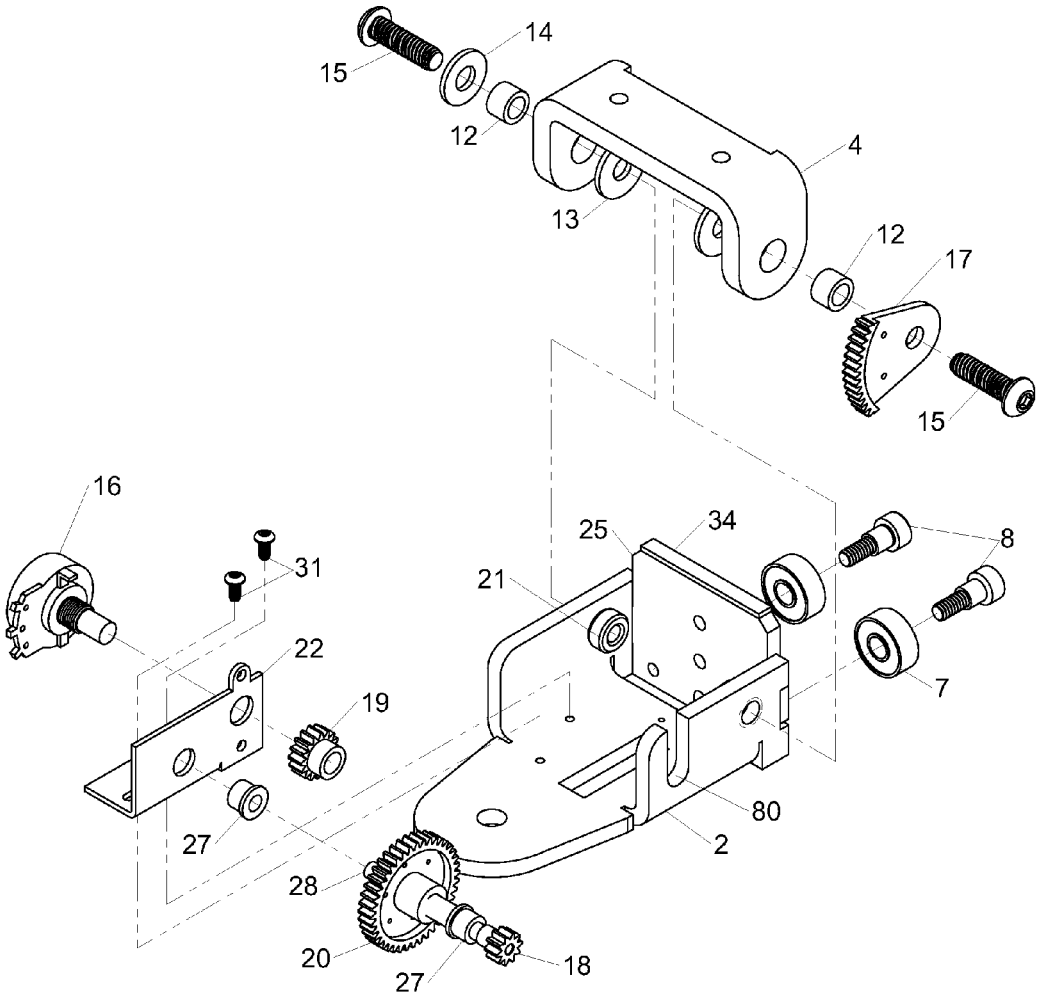
FIG. 3 is a perspective rear left-side view of a detailed exploded assembly of the embodiment of FIG. 2.

FIG. 3 is a perspective rear left-side view of an exploded assembly of the rotational assembly 50 of the embodiment shown in FIG. 2. A pedal pivot mount 4 is attached to a pivot fixture 2 with a pivot screw 15 in two places. The pedal pivot mount 4 provides an extension on each end that is substantially perpendicular to the plate of the pedal plate 3 where each end extension includes a hole that aligns with a hole in the pivot fixture 2. The pivot screw 15 is fastened to the pivot fixture 2 with a nut 21. A pivot bearing 12 is inserted in the two large holes in the extensions of the pedal pivot mount 4. A nylon washer or washer 13 is located between the pivot fixture 2 and the pedal pivot mount 4 on both sides. The longitudinal center of the pivot screw 15 is the center of rotation of the pedal plate 3 about another axis relative to the pedal base 1, and it will be appreciated from the figures and the discussion below with reference to FIGS. 4A and 4B that this center of rotation at screw 15 is non-coincident with the center of rotation at screw 29 of FIG. 2.

On the left side of the pedal pivot mount 4 a pedal drive gear or drive gear 17 is located. On the right side of the pedal pivot mount 4 a pivot washer 14 is located between the pivot screw 15 and the pedal pivot mount 4. The drive gear 17 has the same rotational motion as the pedal pivot mount 4. The drive gear 17 engages a shaft drive gear 18 that is pressed on a shaft 28. A shaft gear 20 is pressed on to the shaft 28 and located interior to the pivot fixture 2. The shaft 28 has a shaft bearing 27 between the shaft drive gear 18 and the shaft gear 20. This shaft bearing 27 engages a slot 80 in the pivot fixture 2. A shaft bearing 27 is located on the shaft 28 between the shaft gear 20 and a mounting bracket 22. The shaft bearing 27 engages a hole in the mounting bracket 22.

A device with a mechanically modifiable electrical characteristic such as a rotational pot, rotary pot or rotational potentiometer 16 is mounted through a hole in the mounting bracket 22. Again, the number of devices to be used is dependent upon the number of functions to be performed by the rotation of the pedal plate 3 about the particular axis of rotation. Additionally, the device(s) for this axis of rotation may be of other types besides a resistive potentiometer, such as a variable inductor or variable capacitor. A potentiometer gear or pot gear 19 is pressed on the rotational potentiometer 16 once mounted in the mounting bracket 22. The pot gear 19 engages the shaft gear 20. The gearing system including the drive gear 17, drive gear 18, shaft gear 20, and pot gear 19 provide an amplification of the rotation of the pedal plate 3 in the up/down axis so as to provide more rotation of the shaft of the rotational potentiometer 16 for a given amount of rotation of the pedal plate 3 so that a broader range of electrical characteristic variation can be provided by the up/down axis movement of the pedal plate 3.

The mounting bracket 22 is attached to the pivot fixture 2 with a shaft bracket screw 31 at two places. A front plate 25 is welded or otherwise attached to the front of the pivot fixture 2. A hole is provided in the front plate 25 to engage each of the three slider pots 24 in FIG. 2. A roller bearing 7 is attached to the front plate 25 with a roller bearing screw 8 at two locations, and it may be desirable in some embodiments for these two locations to be as far apart as possible. As discussed below in relation to FIGS. 15 and 16, the roller bearing 7 may be replaced by a polymer based bushing.

Figure 4A:
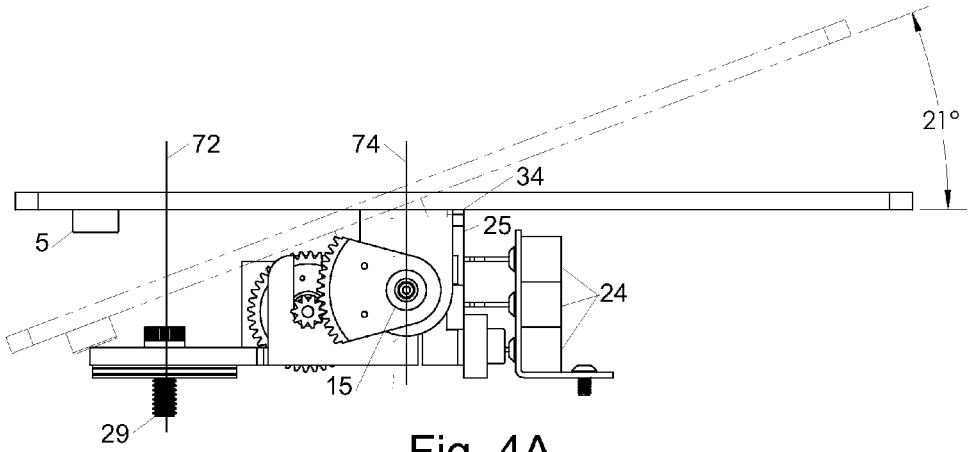
FIG. 4A is a left side view of the assembled parts of the embodiment of FIG. 2 showing rotation about a first axis and first center of rotation.

FIG. 4A is a left-side view of the pedal plate 3 mounted to the rotational assembly 50 engaged with the three stacked slider pots 24. A stop pad 34 is adhered along the length of the top of the front plate 25. A rubber bumper 5 is screwed to the rear and bottom of the pedal plate 3 on center. As can be seen, in this particular embodiment the pedal plate 3 has an up/down rotational axis that provides a range of motion of 21 degrees. This range of motion is a matter of design choice.

As further shown in FIG. 4A, a plane 74 of the center of rotation about the up/down axis is spaced by a significant distance from a plane 72 of the center of rotation about the left/right axis such that the centers of rotation of the up/down axis and the left/right axis of the pedal plate 3 are non-coincident. As a result, the movement in one axis of rotation is better isolated from the movement in the other axis of rotation.

Furthermore, the center of rotation of the left/right axis, which is the longitudinal center of screw 29, is centered with the heel of the user rather than being at the same front-to-rear location as the up/down center of rotation which is the longitudinal center of screw 15. As can be seen, the up/down center of rotation is proximate to a middle point along the front to rear length of the pedal plate 3. By positioning the left/right center of rotation at the center of the heel position rather than proximate the middle of the length, the user is able to more naturally pivot the pedal about the left/right axis as human anatomy allows for the foot to naturally pivot left and right about the center of the heel. It is unnatural for the foot to pivot left and right about the mid-point of the foot and requires significant leg movement which may be undesirable and may result in unintended motion in the up/down axis.

Figure 4B:
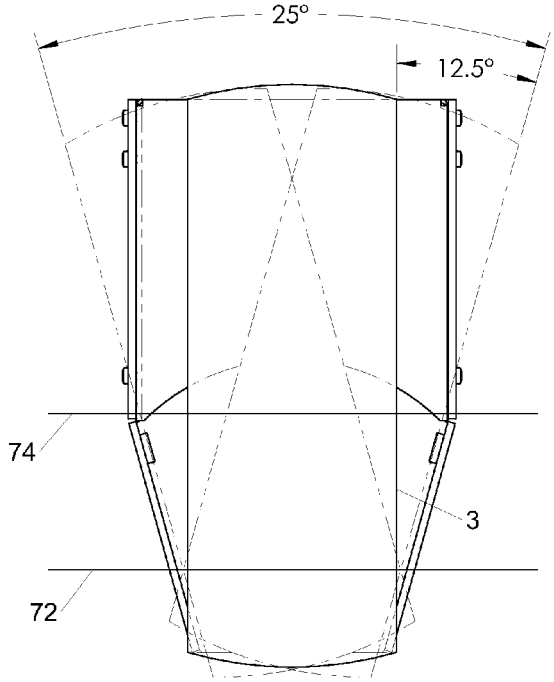
FIG. 4B is a top view of the assembled parts of the embodiment of FIG. 2 showing rotation about a second axis and second center of rotation.

FIG. 4B shows a top view showing the left/right rotation of the pedal plate 3. In this particular embodiment, the range of motion from the center position to a left or right extreme is 12.5 degrees for a stop-to-stop travel of 25 degrees. However, as with the up/down axis, this range of motion is a matter of design choice. Furthermore, FIG. 4B also illustrates the separation of the planes 72 and 74 through the centers of rotation of the left/right and up/down axes, respectively, to further illustrate the non-coincident relationship of these centers of rotation. As can be seen in FIG. 4B, the center of left/right rotation is at a point of the pedal plate 3 that is the mid-point of the width of the pedal plate 3 and is spaced from the rear of the pedal plate 3 by an amount substantially the same as one-half of the width. This location places the center of left/right rotation at the center of the heel.

Figure 16A:
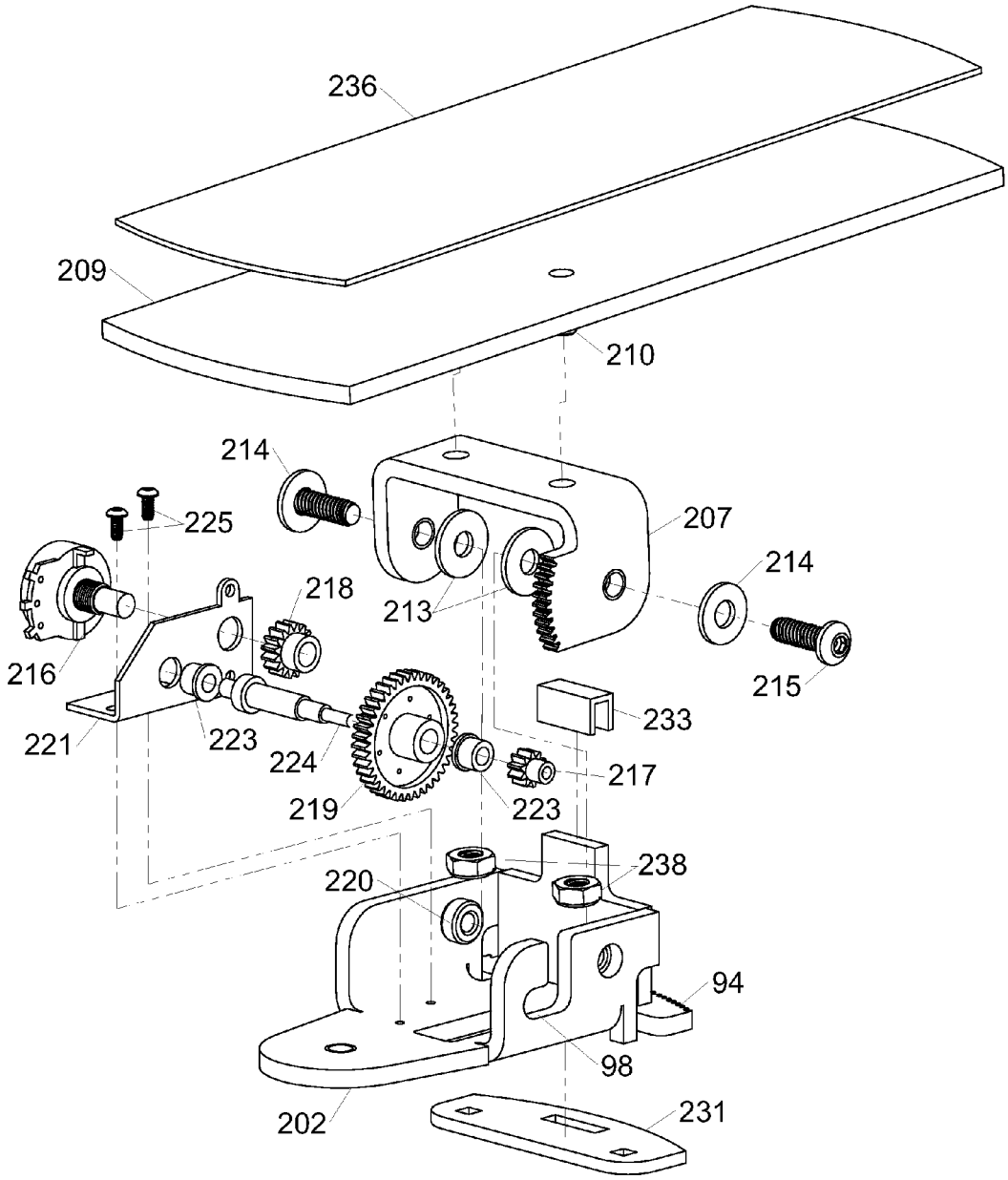
FIGS. 16A and 16B are perspective rear left-side views of detailed exploded assemblies of the alternative embodiment of FIG. 15.

FIG. 15 shows a perspective view of a detailed exploded assembly view of an alternative embodiment of a rotational assembly 90. This rotational assembly 90 may be substituted for the rotational assembly 50 and the three slider pots 24 discussed above in order to pivotably support the pedal plate 3 relative to the pedal base 1. The rotational assembly 90 includes a pivot fixture 202 which includes front extensions 94 where teeth are provided across the front edge of the pivot fixture 202. As shown, the teeth are laser cut or otherwise directly formed on the pivot fixture 202 but it will be appreciated that the teeth may be a separate piece rigidly attached to the pivot fixture 202. The pivot fixture 202 further includes perpendicular extensions where one of the perpendicular extensions has an L-shaped slot 98 that receives the shaft 224 (FIG. 16A).

To mount the rotational assembly 90 to the pedal base 1, a washer 234 and a polymeric bushing 232 are included where screw 29 is used to create the attachment to the pedal base 1.

On the opposite end of the pivot fixture 202, another polymeric pad or bushing 231 is places between the pivot fixture 202 and the pedal base 1. These polymeric bushings may be constructed of nylon, Teflon® material, and other polymeric substances. The pedal plate is attached to the rotational assembly 90 via pedal pivot mount 207 which includes perpendicular extensions where one of those extensions includes teeth 93 that are laser cut or otherwise formed on the extension of mount 207 to form a gear that meshes with drive gear 217.

Rather than including the bracket 23 and slider pots 24, a different support bracket 230 is included that mounts directly to the pedal base 201. Upon the bracket 230, devices such as potentiometers 99 are positioned. Three potentiometers, including 99', 99", and 99'" are shown. Furthermore, it is shown that there is a single potentiometer 99'" and there is also a double-ganged potentiometer that includes potentiometers 99' and 99". The number of devices, and whether to use individual devices or ganged devices, is a matter of design choice. To manipulate the potentiometers 99, pot gears 229 mesh with the teeth 94 of the pivot fixture 202.

Figure 16B:
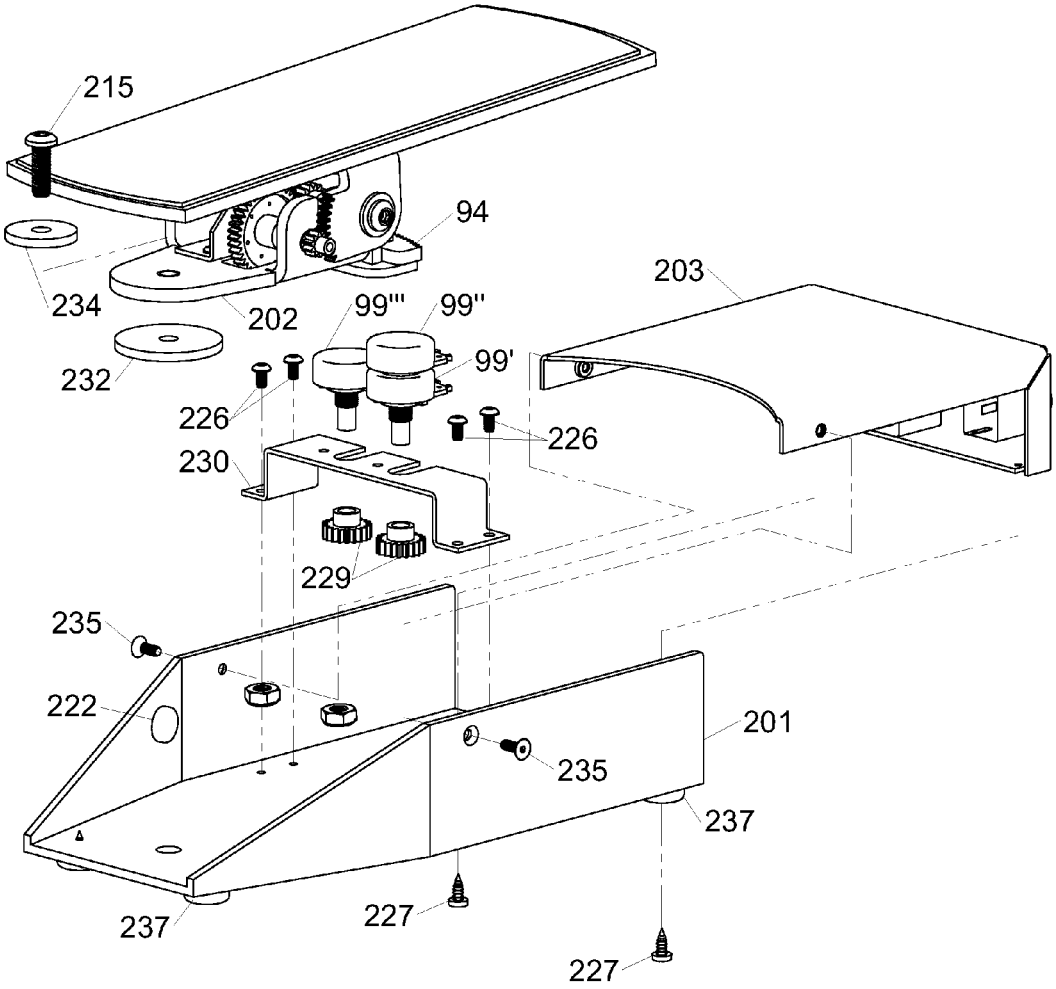

FIGS. 16A and 16B show exploded views of this alternative embodiment. As can be seen, pot gears 229 for each of the pot 99'", and the ganged pot 99', 99" attach to the shaft of the potentiometer and then mesh with the teeth 94 of the pivot fixture 202. Further details of each item of these figures are set forth in a bill of materials of FIG. 20.

Figure 5:
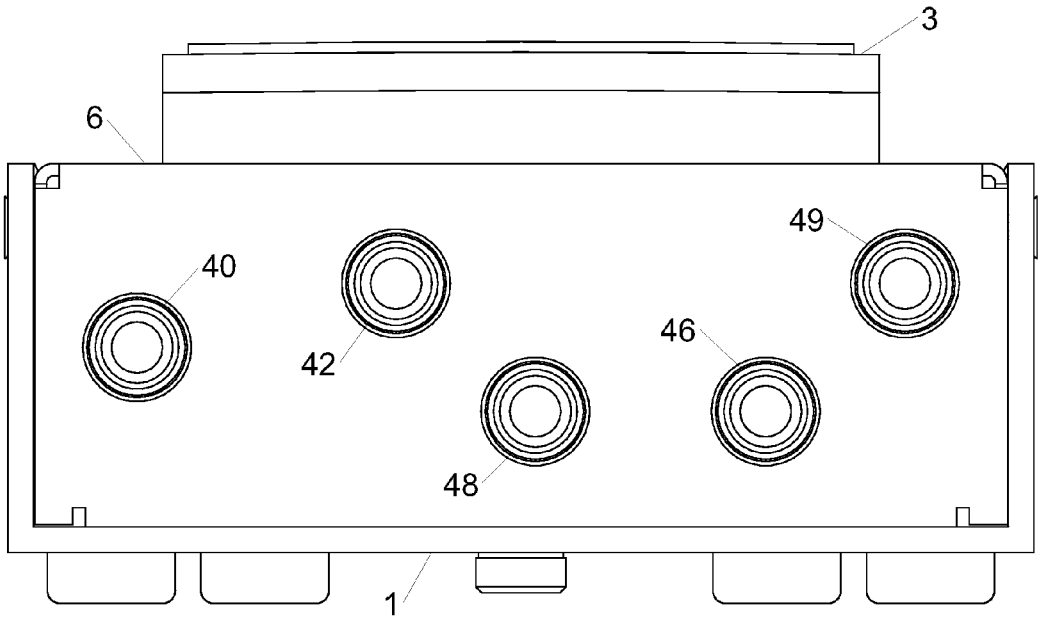
FIG. 5 is a front side view showing the jacks of the embodiment of FIG. 1.

FIG. 5 shows a view of the front of the cover 6 of an embodiment of the pedal assembly 100 where the jacks are located. As shown for this embodiment, these jacks are phone jacks. Other types of jacks are also suitable depending upon the type of plug that is intended to be inserted into each of the jacks being provided. In this illustrative embodiment, five jacks are provided. The purpose of each of these jacks is discussed below in relation to FIGS. 6-14. It will be appreciated that the number of jacks is a matter of design choice dependent upon the number of functions that the pedal should perform.

Figure 6:
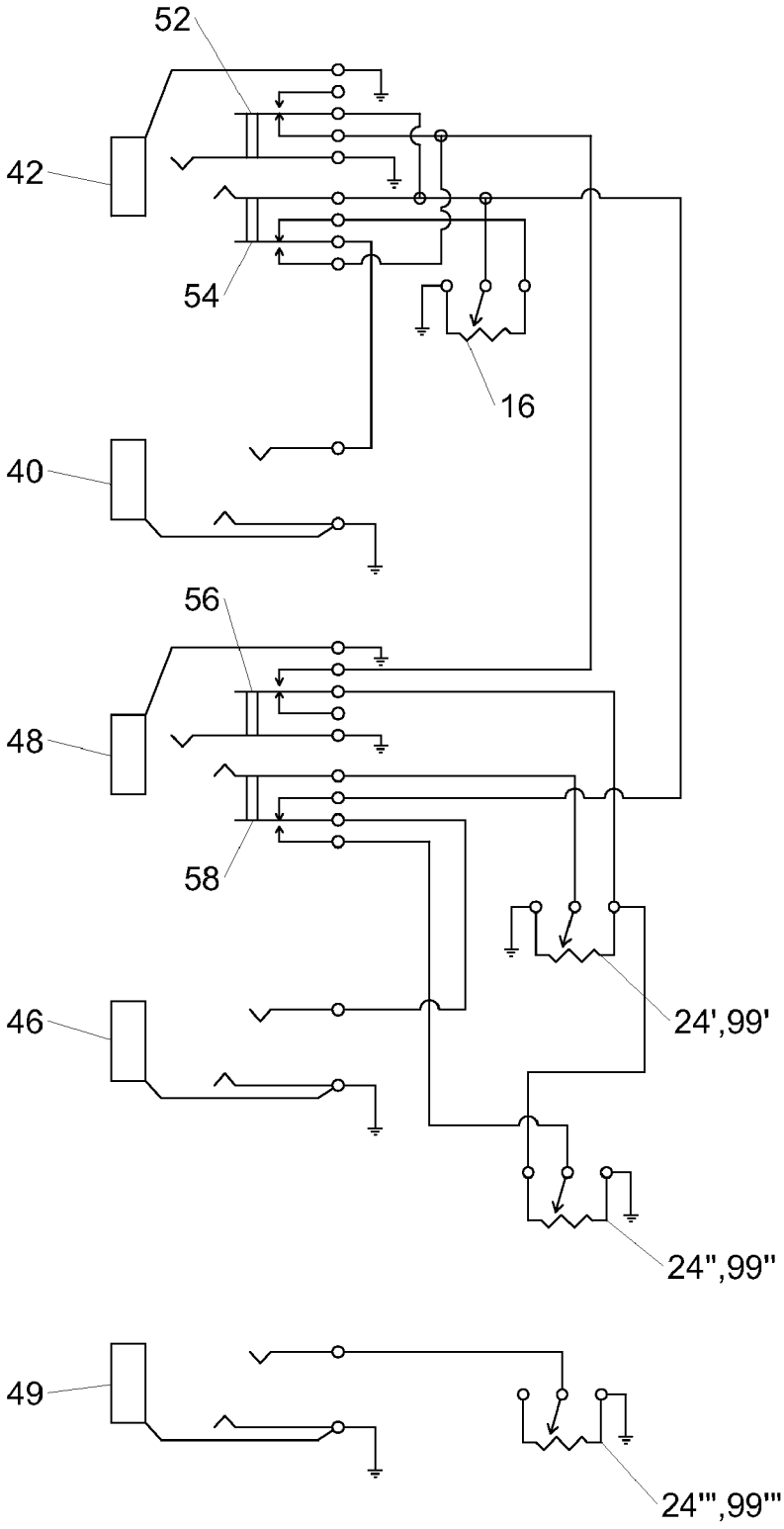
FIG. 6 is a wiring schematic of the electrical connection of jacks to potentiometers of an embodiment of the pedal assembly.

FIG. 6 is a wiring schematic showing the electrical connections between the jacks and the devices with variable electrical characteristics, or potentiometers in the particular examples shown. The wiring schematic of FIG. 6 represents a state where no plugs have been inserted into any of the jacks of the pedal assembly. The wiring schematics of FIGS. 7-14 represent various states where plugs have been inserted in some combination to configure the pedal assembly so that each axis has a particular type of signal control. The wiring schematics of FIGS. 6-14 are provided for purposes of illustration. It will be appreciated that the number of jacks to include, the number of devices with variable electrical characteristics that are included, and the particular wiring configurations shown are all a matter of design choice that are dependent upon the particular functions desired.

In the example shown, the embodiment of the pedal assembly provides for volume control, left-right panning, and midi (Musical Instrument Digital Interface) control for a parallel effects loop to be individually or collectively controlled by one or more axes of the pedal assembly. It will be appreciated that these parameters are examples of use of the pedal assembly for musical instrument applications. However, it will also be appreciated that the pedal assembly may provide for other parameters in other contexts, such as providing for acceleration, braking, steering, etc. for real or virtual vehicles. Thus, while the schematic is discussed in relation to a musical instrument context, this discussion is provided only for purposes of illustration and is not intended to limit the scope of the present disclosure to only the musical instrument context.

As shown in FIG. 6, an input jack 40 is connected to an up/down (U/D) Midi jack 42. The U/D Midi 42 is an isolated double pole double throw switching jack, where the two switches 52 and 54 are shown. The U/D axis rotational potentiometer 16 is also wired to the U/D Midi jack 42 subject to operation of switch 54.

A left jack 46 is connected to the slider pot 24" or rotational pot 99". A right jack 48 is wired to the second slider pot 24' or rotational pot 99". The right jack 48 is also an isolated double pole double throw switching jack, where the two switches 56 and 58 are shown. A left/right (L/R) Midi jack 49 is connected to a third slider potentiometer 24'" or rotational pot 99'". Opposite poles of the first and second slider pots 24', 24" or the first and second rotational pots 99', 99" are wired to the right switching jack 48 which is in turn wired to the to the U/D Midi switching jack 42. All the negative terminals of all the jacks are grounded as are all negative terminals of the slider pots 24', 24", 24'" or rotational pots 99', 99", and 99'" as well as rotational pot 16.

In operation one uses the expression pedal in a normal manner with a source signal from an instrument or midi device, in the musical context, or with source signals from other devices in other contexts. The foot pedal in FIG. 1 is placed on the floor and the user's foot is placed on the pedal 3. The pedal 3 will rock back and forth and rotate left to right as shown in FIGS. 4A and 4B. The back and forth motion controls the rotational potentiometer 16 while the left to right motion controls the three slider pots 24', 24", and 24'" or three rotational pots 99', 99", and 99'".

Figure 7:
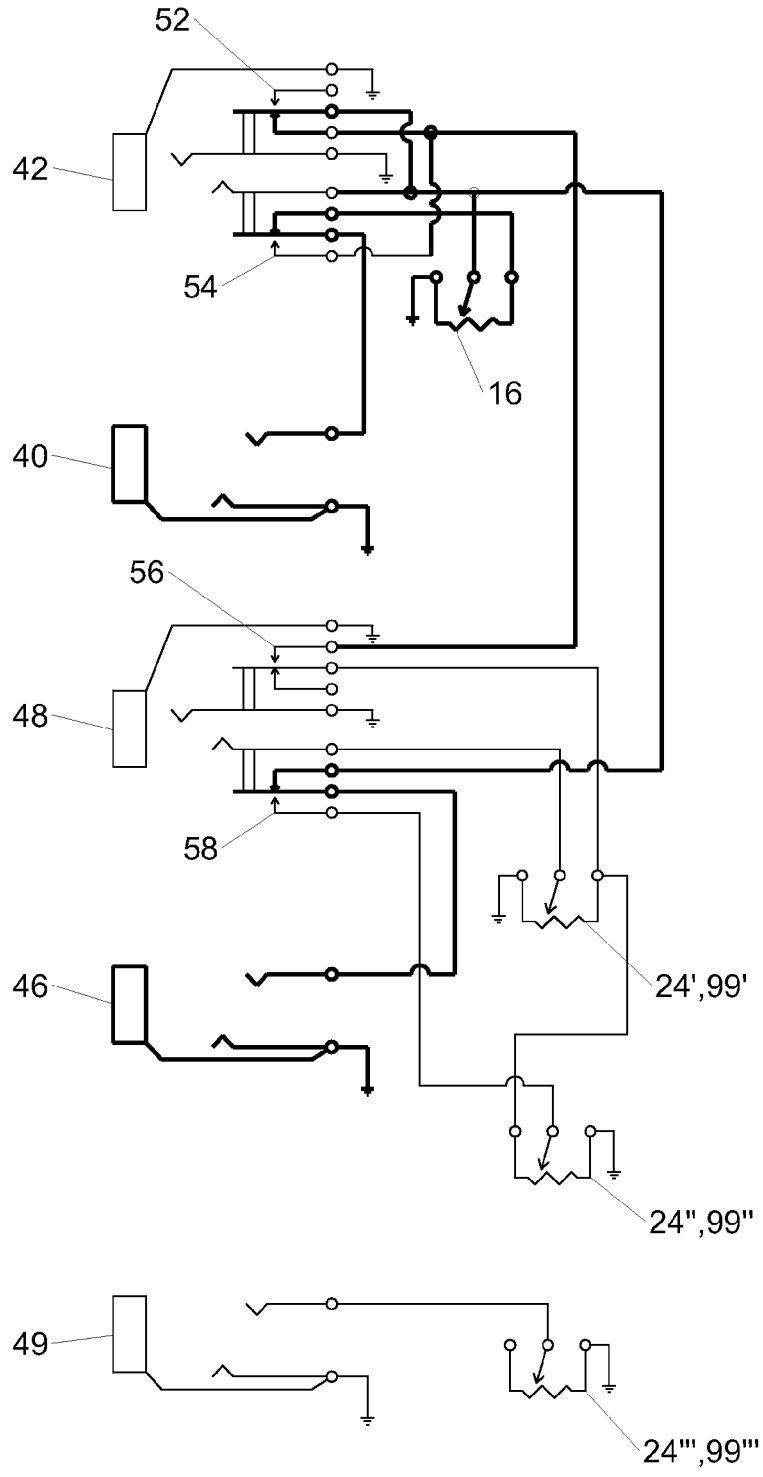
FIG. 7 is the wiring schematic of the electrical connection of jacks with a plug inserted into a left jack to configure the pedal assembly for up/down volume control.

As shown in FIG. 7, with an analog input plugged into an input jack 40, which is wired to the U/D midi switching jack 42, and a line out plugged into the left vol only jack 46, the foot pedal assembly 100 controls the volume (or other non-musical parameter related to signal amplitude) in back and forth or up/down motion. As can be seen in FIG. 7, in this plug-in configuration where no plugs are present in the U/D midi jack 42, right jack 48, or L/R midi jack 49, only the potentiometer 16 is in the electrical pathway between the input jack 40 and the left jack 46 such that potentiometer 16 controls the amplitude of the signal, while the pots 24', 24", 24'" or pots 99', 99", 99'" for the l/r motion are isolated from the signal path such that l/r motion has no effect on the signal of the left jack 46.

Figure 8:
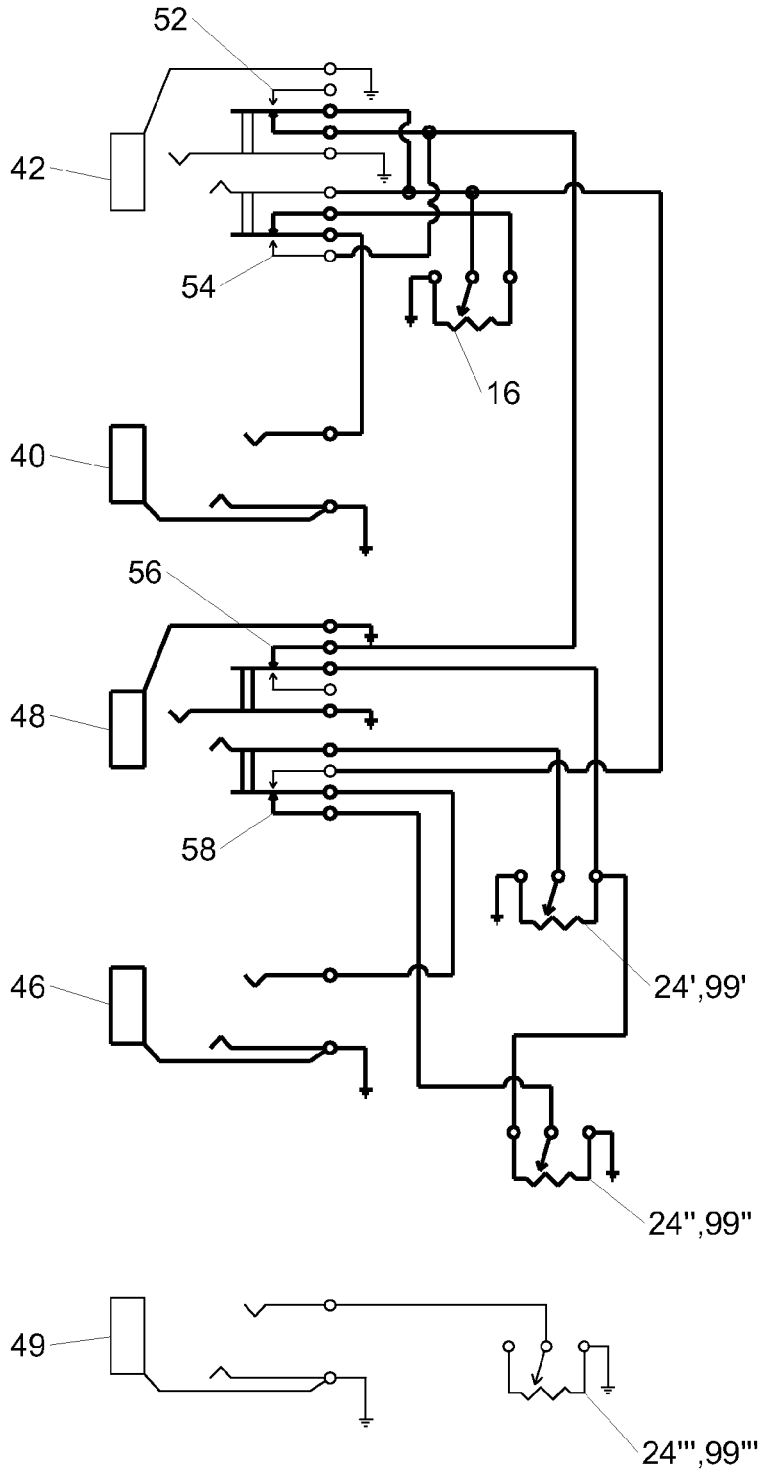
FIG. 8 is the wiring schematic of the electrical connection of jacks with plugs inserted to configure the pedal assembly for up/down volume control with left/right panning.

As shown in FIG. 8, with an analog input plugged into the input jack 40 and a line out plugged into the left jack 46 and another line out plugged into the right jack 48, the foot pedal assembly 100 works as a volume pedal in back and forth or up/down motion and pans left and right with left/right motion. As can be seen in FIG. 8, in this plug-in configuration where no plugs are present in the U/D mid jack 42 or L/R midi jack 49, the pot 16 is present in the electrical circuit path. Furthermore, from pot 16, pot 24' or 99' is also present in the electrical pathway to the right jack 48 while pot 24" or 99" is present in the electrical pathway to the left jack 46. Thus, the pot 16 controls the volume for both the right jack 48 and the left jack 46 via the up/down motion of the pedal plate 3 while pot 24' or 99' in conjunction with pot 24" or 99" serves to pan the audio signal between the right jack 48 and left jack 46 via the left/right motion of the pedal plate 3.

Figure 9:
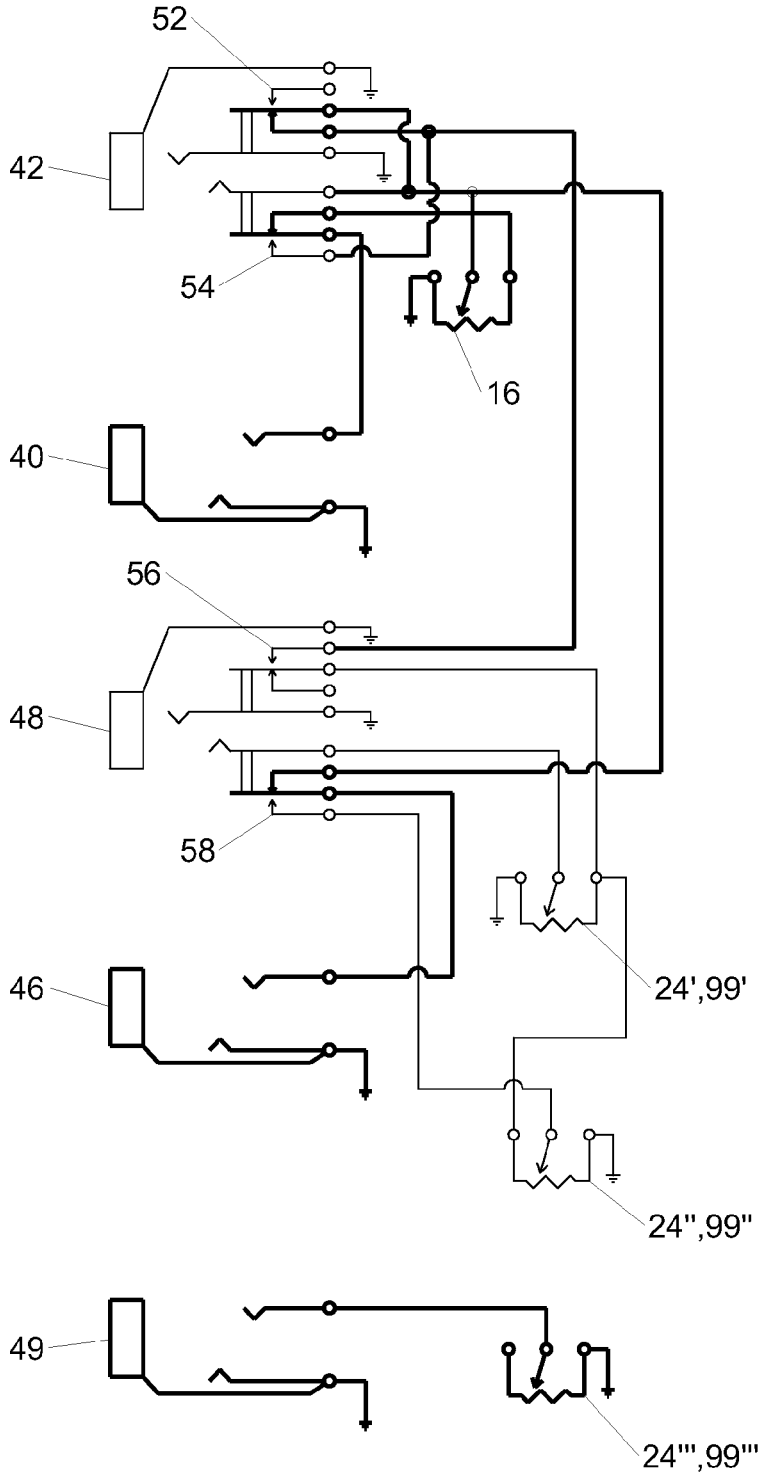
FIG. 9 is the wiring schematic of the electrical connection of jacks with plugs inserted to configure the pedal assembly for up/down volume control with left/right midi control.

As shown in FIG. 9, with a midi signal input plugged into the L/R Midi jack 49, the left/right motion of the pedal plate 3 controls the midi signal by passing the midi signal entering the L/R midi jack 49 through the pot 24'" or 99'". As further shown in FIG. 9, the audio input is plugged into the input jack 40 while the left jack 46 is plugged into for audio output such that the electrical pathway between the input jack 40 and left jack 46 continues to include pot 16 such that the up/down motion of the pedal plate 3 controls the signal amplitude, which is representative of volume in this musical context. Thus, left/right motion may control the midi effects while the up/down motion independently and simultaneously controls the volume.

Figure 10:
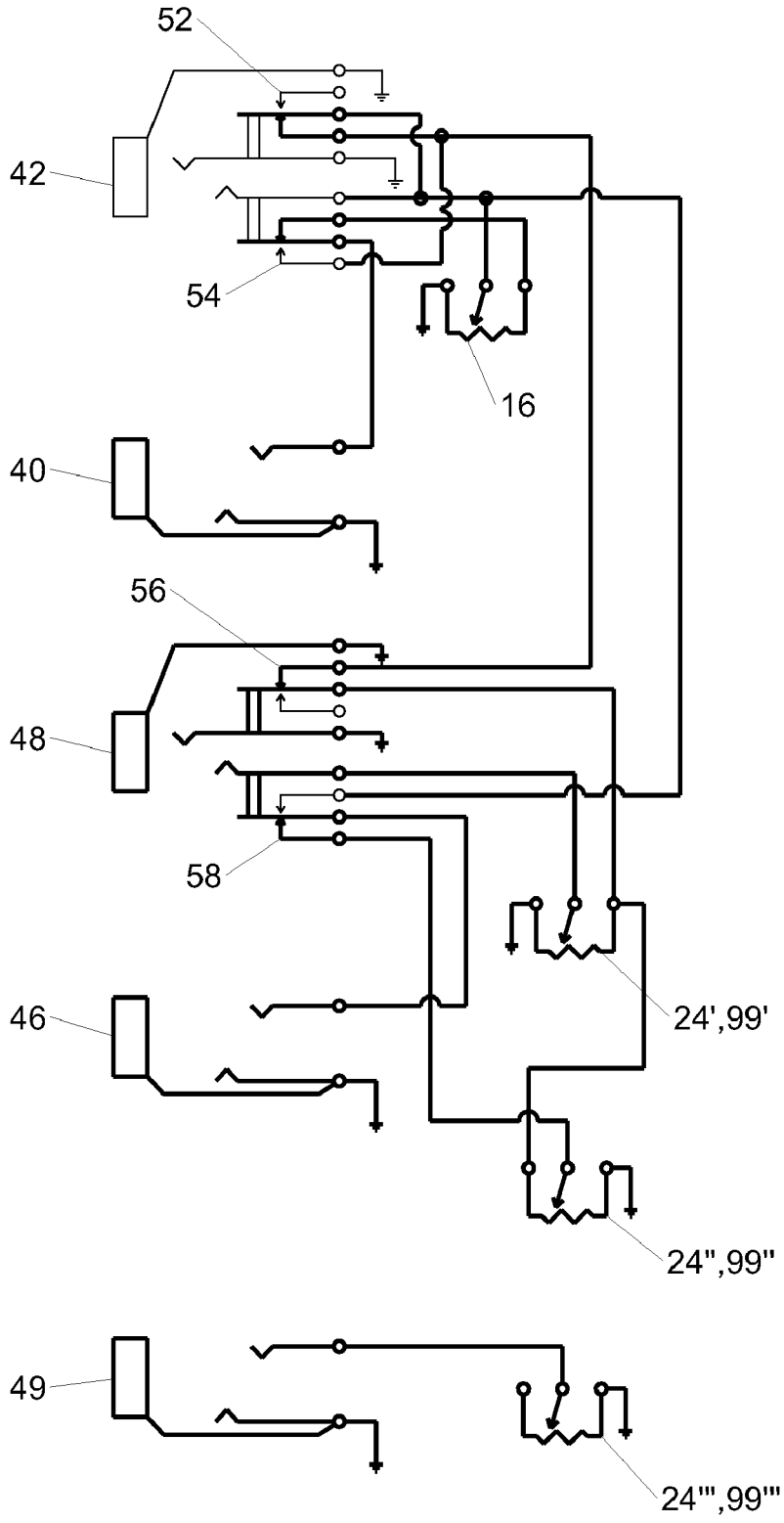
FIG. 10 is the wiring schematic of the electrical connection of jacks with plugs inserted to configure the pedal assembly for up/down volume control with left/right panning and left/right midi control.

As shown in FIG. 10 with a midi signal input plugged into the L/R midi jack 49, the left/right motion of the pedal plate 3 controls the midi signal by passing the midi signal through pot 24''' or 99'''. However, with the input plugged into input jack 40 and output plugged into left jack 46 and right jack 48, the pot 16 is present in the electrical circuit path so that volume is controlled by the up/down motion of the pedal plate 3. Furthermore, from pot 16, pot 24' or 99' is also present in the electrical pathway to the right jack 48 while pot 24" or 99" is present in the electrical pathway to the left jack 46. Thus, pot 24' or 99' in conjunction with pot 24" or 99" serves to pan the audio signal between the right jack 48 and left jack 46 via the left/right motion of the pedal plate 3. Therefore, up/down motion independently and simultaneously controls the volume while the left/right motion controls both the left/right panning as well as the effects control.

Figure 11:
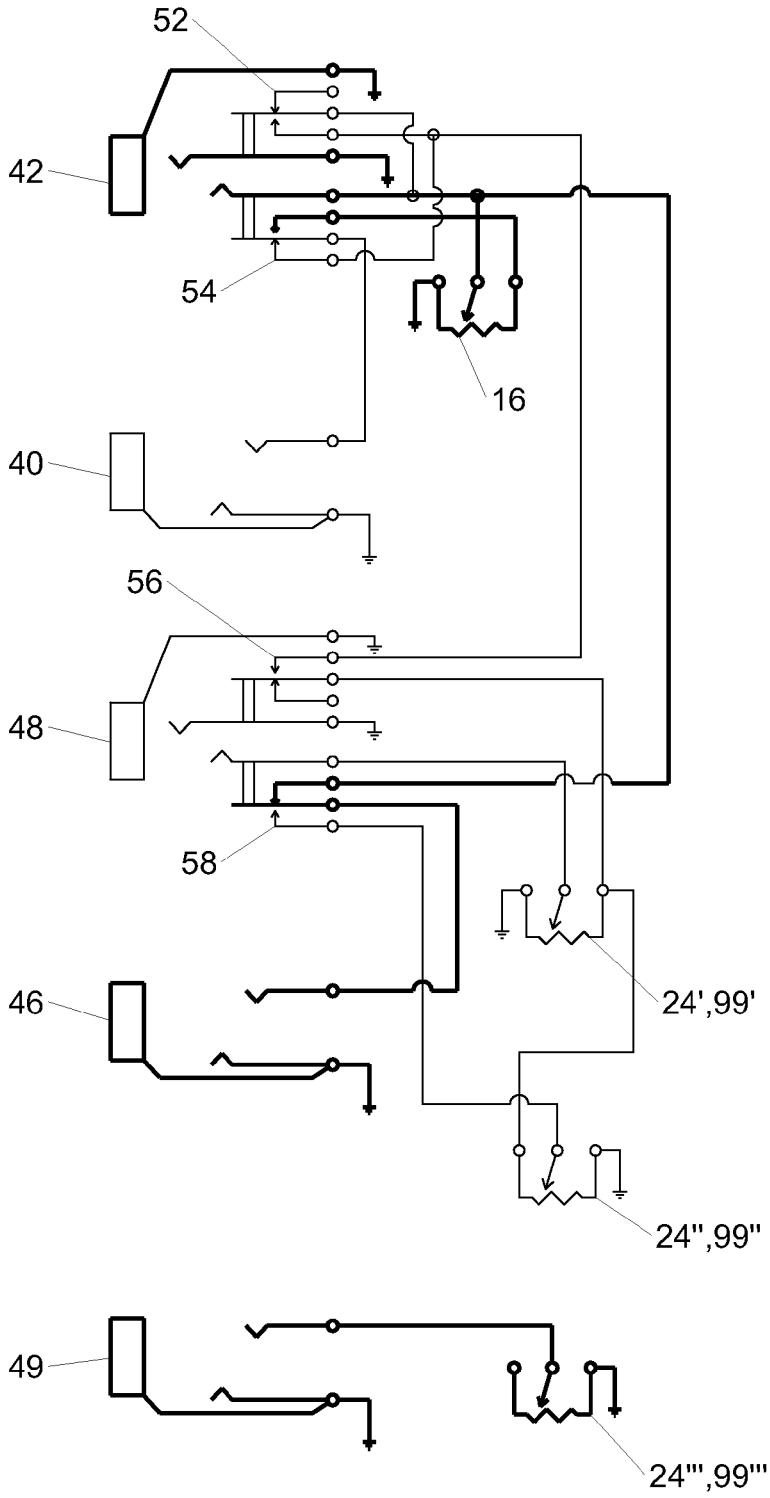
FIG. 11 is the wiring schematic of the electrical connection of jacks with plugs inserted to configure the pedal assembly for up/down midi control with left/right midi control.

As shown in FIG. 11, with a midi signal input plugged into the U/D midi jack 42, the back and forth or up/down motion controls the midi signal due to the midi signal electrical pathway passing through the pot 16. Furthermore, with another midi signal plugged into the L/R midi jack 49, the left/right motion controls this other mid signal due to this midi signal electrical pathway passing through the pot 24''' or 99'''.

Figure 12:
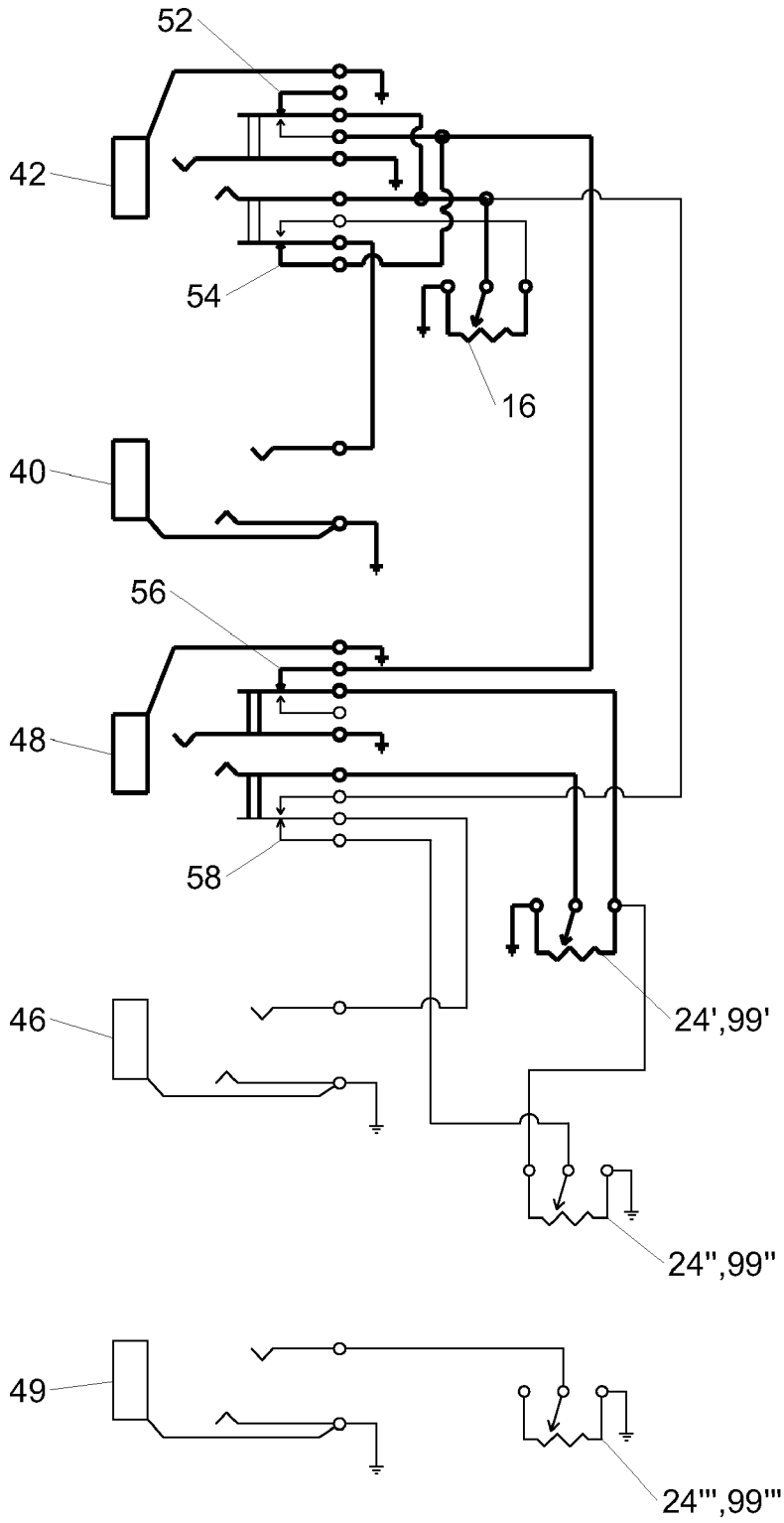
FIG. 12 is the wiring schematic of the electrical connection of jacks with plugs inserted to configure the pedal assembly for up/down midi control with left/right volume control.

As shown in FIG. 12, with a midi signal input plugged into the UD midi jack 42 and with an input plugged into input jack 40 and an output plugged into right jack 48, the up/down motion can be used to control the midi effects while the left/right motion controls the signal amplitude out of the right jack 48. The midi effects electrical pathway passes through pot 16 while the electrical pathway between the input jack 40 and output jack 48 passes through pot 24' or 99'.

Figure 13:
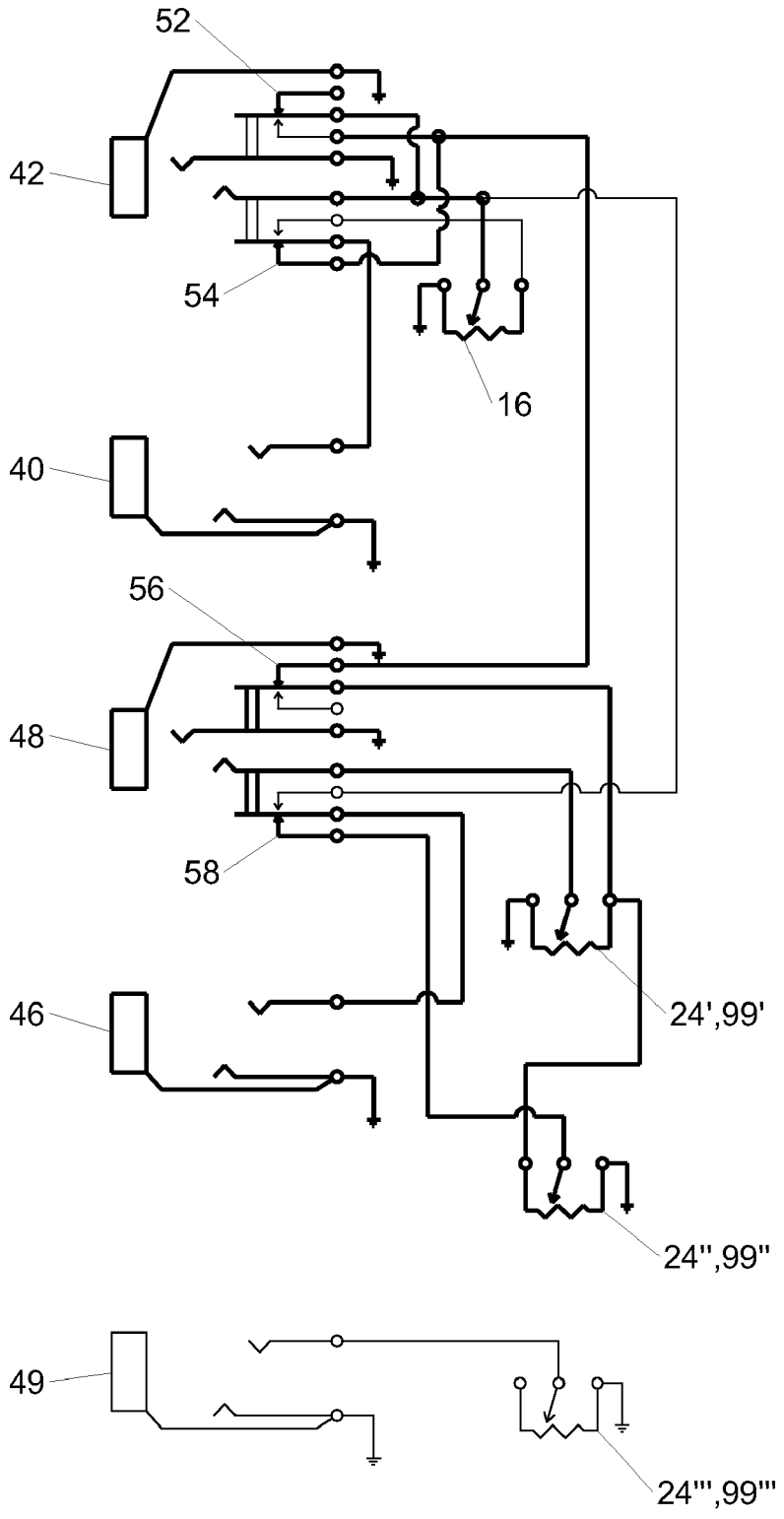
FIG. 13 is the wiring schematic of the electrical connection of jacks with plugs inserted to configure the pedal assembly for up/down midi control with left/right panning.

As shown in FIG. 13, with a midi signal input plugged into the UD midi jack 42 and with an input plugged into input jack 40, an output plugged into right jack 48, and another output jack plugged into left jack 46, the up/down motion can be used as a midi continuous controller while the left/right motion controls the panning between the right jack 48 and left jack 56. The midi effects electrical pathway passes through pot 16 providing for the up/down control. The electrical pathway between the input jack 40 and right jack 48 passes through pot 24' or 99' while the electrical pathway between the input jack 40 and the left jack 46 and passed through pot 24" or 99".

Figure 14:
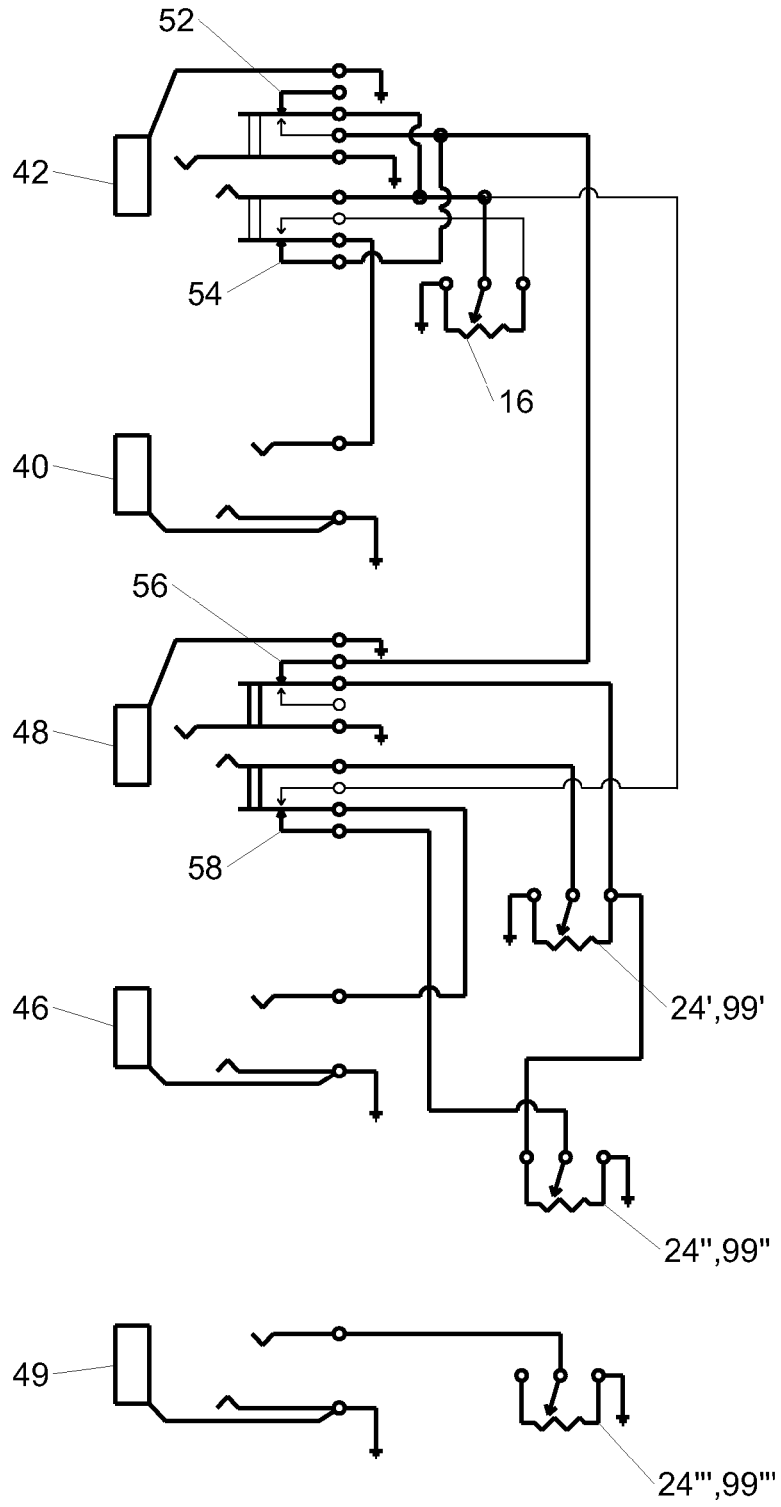
FIG. 14 is the wiring schematic of the electrical connection of jacks with plugs inserted to configure the pedal assembly for up/down midi control with left/right midi control and with left/right panning.

As shown in FIG. 14, adding a midi plug into the L/R midi jack 49 in addition to the configuration of FIG. 13 adds a midi signal control through the left/right motion in addition to the midi signal control through the up/down motion. Furthermore, the left/right motion controls both the midi signal and the left/right panning.

As noted above, there are many possibilities with regard to type of displacement transducers or other devices with modifiable electrical characteristics that are applicable. The embodiment shown and described uses potentiometers but this embodiment is disclosed for purposes of illustration and is not intended to be limiting. For example, a single optical electrical transducer can be applied to each axis to provide signal control. In addition, two of the slide potentiometers 24 can be replaced with one ganged dual slider potentiometer. Furthermore, as shown in FIG. 15, these slide potentiometers 24', 24", and 24''' can be replaced with rotational potentiometers 99', 99", and 99'''. There are also alternate possibilities with regard to the roller bearings 7 and the thrust bearing assembly 9 used with the left to right motion. Here the bearings can be eliminated as noted above, and a low friction material can be applied between the pedal base 1 and the pivot fixture 2.

There are also alternate possibilities with regard to the gears used in FIG. 3. Here a cable and pulley type system could be implemented and connected to the transducers or other devices. In addition, two gears could be eliminated by extending the length of the pivot fixture 2 and connecting a rack type gear forward of the vertical pivot axis, similar to that shown in FIG. 15, albeit FIG. 15 utilizes a rotary gear. Another alternate embodiment would be to have an enclosed base housing the connection jacks. In this fashion, the pivot fixture 2 would mount to the top of the enclosed box type base and the left to right control could be located interior to the box type base.

Figure 17:
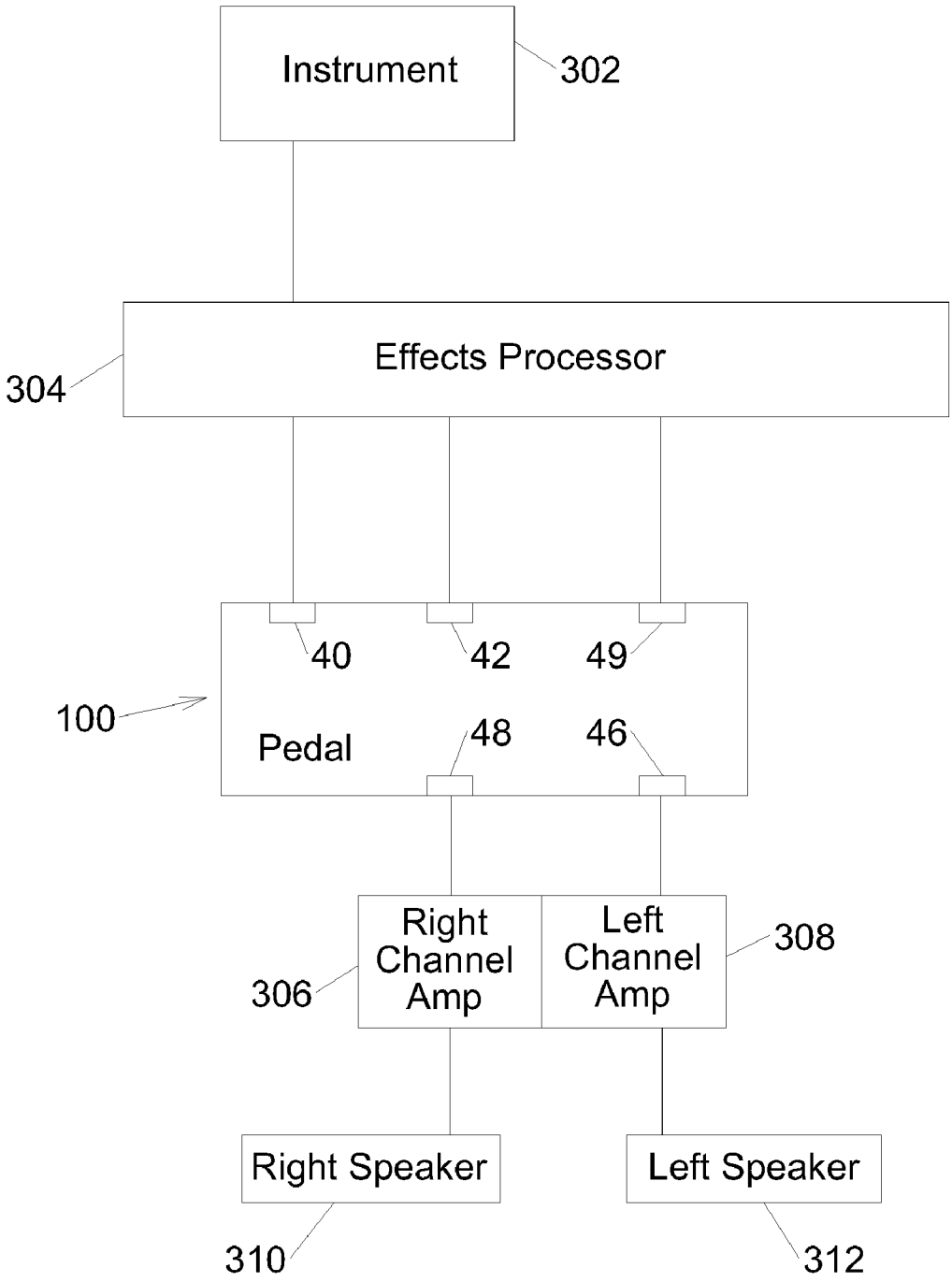
FIG. 17 shows one connection configuration of the pedal assembly in the musical instrument context.

FIG. 17 shows one configuration of connections between equipment in the context of musical instruments. Here, a musical instrument 202 such as a guitar outputs an audio signal via a signal lead. The audio signal is received at an effects processor 204. The effects processor has one or more parallel effects loop signals output via signal leads, where one lead connects to jack 42 of the pedal assembly 100 while another lead connects to jack 49. Thus, the pedal assembly controls the application of these effects to the audio signal. The audio signal as modified by these effects is output from the effects processor 204 to input jack 40 of the pedal assembly.

The pedal assembly 100, in this illustrative configuration, outputs a right audio signal from jack 48 and a left audio signal from jack 49, where the pedal assembly allows for panning between the two. The right audio signal is provided via lead to a right channel amplifier 206 which drives a right channel speaker 210. Likewise, the left audio signal is provided via a lead to a left channel amplifier 208 which drives a left channel speaker 212.

Figure 18:
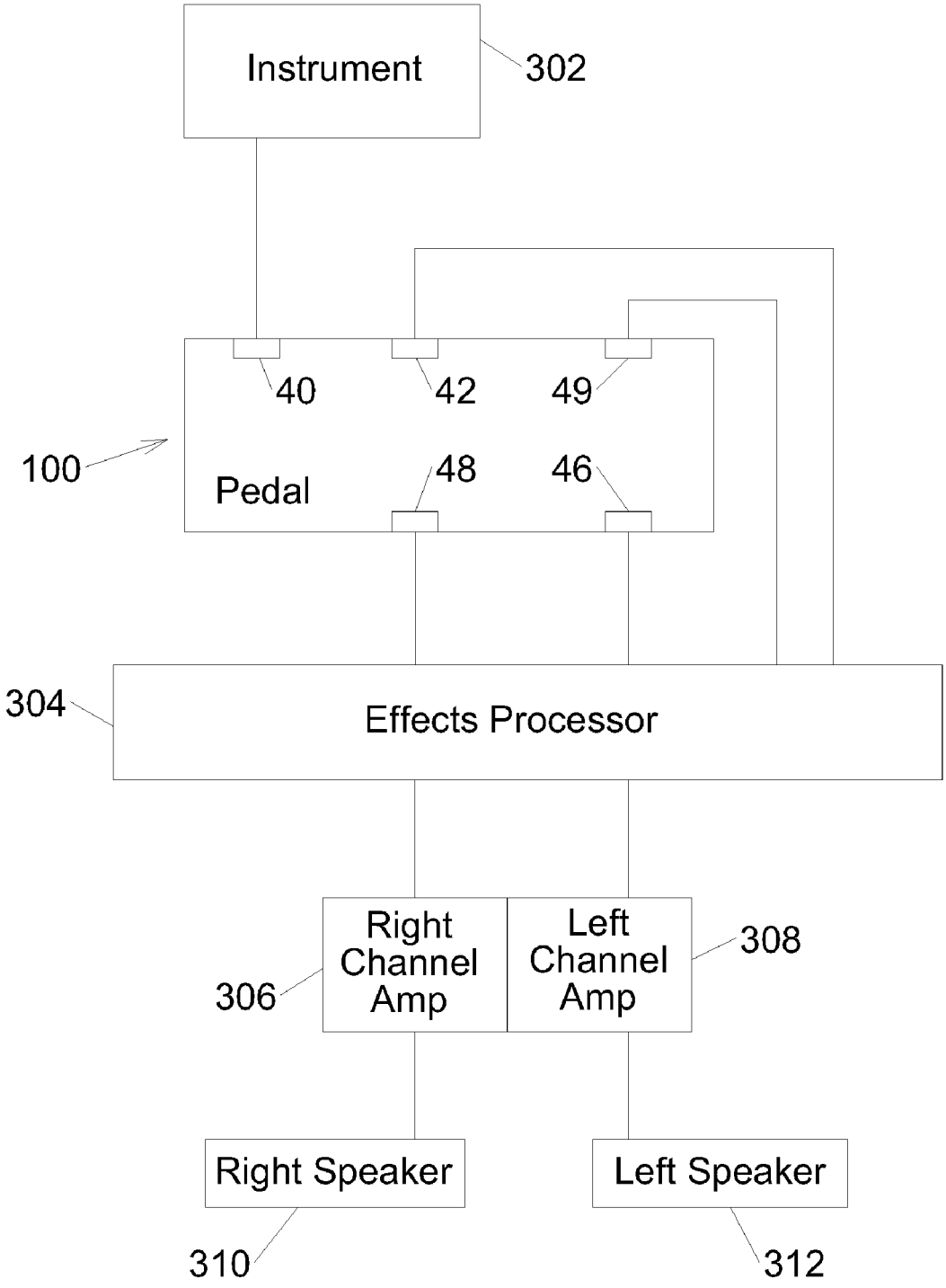
FIG. 18 shows an alternative connection configuration of the pedal assembly in the musical instrument context.

FIG. 18 shows an alternative configuration of connections. Here, the instrument 202 outputs an audio signal via a signal lead. The audio signal is received at the input jack 40 of the pedal assembly 100. The pedal assembly 100 outputs right audio via jack 48 and left audio via jack 46, where these audio signals are provided via leads to the effects processor 204, such that the pedal assembly 100 provides for left/right panning. The effects processor 204 provides parallel effects loop signals to jacks 42 and 46 so that the pedal assembly provides effects loop control.

The effects processor 204 outputs a right audio signal with effects to the right channel amplifier 206 driving the right speaker 210. Likewise, the effects processor 204 outputs a left audio signal with effects to the left channel amplifier 208 driving the left speaker 212.

FIGS. 19 and 20 each show a bill of materials for the embodiments of FIGS. 2 and 3 and FIGS. 15, 16A, and 16B, respectively. The materials are provided for purposes of illustration only and are not intended to be limiting. It will be appreciated that other materials may be substituted in place of those shown.

While the invention has been particularly shown and described with reference to various embodiments thereof, it will be understood by those skilled in the art that various other changes in the form and details may be made therein without departing from the spirit and scope of the invention.

What is claimed is:

1. A pedal assembly for signal control, comprising:

a pedal base; and a pedal plate rotational assembly pivotally supported in relation to the pedal base, the pedal plate rotational assembly having a first center of rotation relative to the pedal base about a first axis and having a second center of rotation relative to the pedal base about a second axis, the first center of rotation being non-coincident with the second center of rotation, the pedal plate rotational assembly comprising teeth forming a gear that rotates relative to the pedal base during rotation of the pedal plate rotational assembly relative to the pedal base.

2. The pedal assembly of claim 1, wherein the pedal plate rotational assembly comprises a pedal plate that has first and second ends establishing a length and first and second sides establishing a width, wherein the first center of rotation is located at a point proximate to a middle between the first and second ends.

3. The pedal assembly of claim 2, wherein the length is greater than the width, and wherein the second center of rotation is located at substantially a middle of the width and at a distance from the second end that is substantially equal to one-half of the width at the second end.

4. The pedal assembly of claim 1, wherein the pedal plate rotational assembly comprises:

a pedal plate;

a pedal plate bracket separate from and affixed to the pedal plate and having extensions protruding away from the pedal plate, and a pedal support plate pivotally attached to the pedal base to provide the second center of rotation, the pedal support plate including extensions substantially parallel and adjacent to the extensions of the pedal plate, the pedal plate bracket being rotatably attached to the pedal support plate to provide the first center of rotation.

5. The pedal assembly of claim 4, wherein the extensions of the pedal plate bracket are in a plane substantially perpendicular to a plane of the pedal plate, the extensions including the teeth that form the gear, the pedal assembly further comprising:

a first axis gear system mounted to the pedal support plate and including a first gear meshing with the gear of the pedal plate bracket; and a first axis device with an electrical characteristic that is mechanically altered, the first axis device mechanically coupled to the first axis gear system such that rotation of the pedal plate about the first axis causes an alteration to the electrical characteristic of the first axis device.

6. The pedal assembly of claim 5, wherein the first axis device is a potentiometer having a shaft coupled to the first axis gear system and wherein the first axis gear system provides an amplification of rotation of the pedal plate to the shaft of the first axis device.

7. The pedal assembly of claim 4, wherein the pedal support plate includes the teeth forming the gear, the pedal further comprising:

a pedal base bracket fixed in relation to the pedal base;

a second axis gear system mounted to the pedal base bracket and including a first gear meshing with the gear of the pedal support plate; and a second axis device with an electrical characteristic that is mechanically altered, the second axis device being mechanically coupled to the second axis gear system such that rotation of the pedal plate about the second axis causes an alteration to the electrical characteristic of the second axis device.

8. The pedal assembly of claim 7, wherein the second axis device is a potentiometer having a shaft coupled to the second axis gear system and wherein the second axis gear system provides an amplification of rotation of the pedal plate to the shaft of the second axis device.

9. A pedal assembly for signal control, comprising:

a pedal base;

a pedal plate pivotally supported in relation to the pedal base, the pedal plate having a first center of rotation relative to the pedal base about a first axis and having a second center of rotation relative to the pedal base about a second axis, the first center of rotation being non-coincident with the second center of rotation;

a pedal plate bracket affixed to the pedal plate; and a pedal support plate pivotally attached to the pedal base to provide the second center of rotation, the pedal plate bracket being rotatably attached to the pedal support plate to provide the first center of rotation.

10. The pedal assembly of claim 9, wherein the pedal plate bracket includes at least one extension including teeth that form a gear, the pedal assembly further comprising:

a first axis gear system mounted to the pedal support plate and including a first gear meshing with the gear of the pedal plate bracket; and a first axis device with an electrical characteristic that is mechanically altered, the first axis device mechanically coupled to the first axis gear system such that rotation of the pedal plate about the first axis causes an alteration to the electrical characteristic of the first axis device.

11. The pedal assembly of claim 10, wherein the first axis device is a potentiometer having a shaft coupled to the first axis gear system and wherein the first axis gear system provides an amplification of rotation of the pedal plate to the shaft of the first axis device.

12. The pedal assembly of claim 9, wherein the pedal support plate includes teeth forming a gear, the pedal assembly further comprising:

a pedal base bracket fixed in relation to the pedal base;

a second axis gear system mounted to the pedal base bracket and including a first gear meshing with the gear of the pedal support plate;

a second axis device with an electrical characteristic that is mechanically altered, the second axis device being mechanically coupled to the second axis gear system such that rotation of the pedal plate about the second axis causes an alteration to the electrical characteristic of the second axis device.

13. The pedal assembly of claim 12, wherein the second axis device is a potentiometer having a shaft coupled to the second axis gear system and wherein the second axis gear system provides an amplification of rotation of the pedal plate to the shaft of the second axis device.

14. A pedal assembly for signal control, comprising:

a pedal base; and a pedal plate pivotally supported in relation to the pedal base, the pedal plate having a first center of rotation relative to the pedal base about a first axis and having a second center of rotation relative to the pedal base about a second axis, the first center of rotation being non-coincident with the second center of rotation, wherein the pedal plate has first and second ends establishing a length and first and second sides establishing a width, wherein the first center of rotation is located at a point closer to a middle point between the first and second ends than to the second center of rotation and the second center of rotation is located closer to the second end than to the first center of rotation.

* * * * *